US007361442B2

(12) United States Patent
Otake et al.

(10) Patent No.: US 7,361,442 B2
(45) Date of Patent: Apr. 22, 2008

(54) DEVELOPING METHOD AND DEVELOPING ASSEMBLY

(75) Inventors: Satoshi Otake, Numazu (JP); Masayoshi Shimamura, Yokohama (JP); Yusutaka Akashi, Yokohama (JP); Kazunori Saiki, Yokohama (JP); Nene Dojo, Numazu (JP); Minoru Ito, Susono (JP); Michihisa Magome, Shizuoka-ken (JP); Eriko Yanase, Shizuoka-ken (JP); Tatsuya Nakamura, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/736,057

(22) Filed: Apr. 17, 2007

(65) Prior Publication Data

US 2007/0238043 A1 Oct. 11, 2007

Related U.S. Application Data

(63) Continuation of application No. PCT/JP2006/313358, filed on Jun. 28, 2006.

(30) Foreign Application Priority Data

Apr. 11, 2006 (JP) ..... 2006-108856

(51) Int. Cl.
*G03G 15/08* (2006.01)

(52) U.S. Cl. ..... 430/122.5; 430/123.3; 399/276

(58) Field of Classification Search ..... 430/122.5, 430/123.3; 399/276

See application file for complete search history.

(56) References Cited

U.S. PATENT DOCUMENTS

| | | | | |
|---|---|---|---|---|
| 5,729,805 | A * | 3/1998 | Chiba et al. | 399/276 |
| 6,391,511 | B1 * | 5/2002 | Okamoto et al. | 430/123.3 |
| 6,841,327 | B2 * | 1/2005 | Otake et al. | 430/123.3 |
| 6,873,816 | B2 * | 3/2005 | Akashi et al. | 399/286 |
| 7,223,511 | B2 * | 5/2007 | Shimamura et al. | 430/124.1 |
| 2005/0048269 | A1 | 3/2005 | Shimamura et al. | 428/195.1 |

FOREIGN PATENT DOCUMENTS

| | | |
|---|---|---|
| JP | 2000-019814 | 1/2000 |
| JP | 2005-077869 | 3/2005 |
| JP | 2005-091437 | 4/2005 |
| JP | 2005-099703 | 4/2005 |
| JP | 2006-084923 | 3/2006 |

* cited by examiner

*Primary Examiner*—John L Goodrow
(74) *Attorney, Agent, or Firm*—Fitzpatrick, Cella, Harper & Scinto

(57) ABSTRACT

A developing method is provided in which a developer is carried on a developer carrying member, a thin layer of the developer is formed thereon and a latent image on a latent image bearing member is developed with a developer. The developer is composed of magnetic toner particles containing a binder resin and a magnetic powder. The magnetic powder has a saturation magnetization of 67.0 $Am^2/kg$ to 75.0 $Am^2/kg$ in a magnetic field of 79.6 kA/m (1,000 oersteds) and has a residual magnetization of 4.5 $Am^2/kg$ or less. In the surface profile of the conductive resin coat layer of the developer carrying member, the relationship $1.00 \leqq S/A \leqq 1.65$ is satisfied where S is a surface area of regions zoned by an area A of microscopic unevenness regions from which parts exceeding a reference plane by 0.5×r (r: weight average particle diameter (μm) of a toner used) or more have been excluded.

10 Claims, 4 Drawing Sheets

DEVELOPING METHOD AND DEVELOPING ASSEMBLY

This application is a continuation of International Application No. PCT/JP2006/313358, filed Jun. 28, 2006, which claims the benefit of Japanese Patent Application No. 2006-108856, filed Apr. 11, 2006.

BACKGROUND OF THE INVENTION

1. Field of the Invention

The present invention relates to a developing method and a developing assembly.

2. Description of the Related Art

A number of methods are conventionally known as methods for electrophotography in which, in general, copies are obtained by forming an electrostatic latent image on a latent image bearing member by utilizing a photoconductive material and by various means, subsequently developing the electrostatic latent image with toner to form a toner image as a visible image, transferring the toner image to a recording medium such as paper as needed, and thereafter fixing the toner image onto the recording medium by the action of heat or pressure or the like.

Image forming apparatus using the above electrophotography include copying machines, printers and so forth. In recent years, these printers and copying machines are increasingly changed over from analogue types to digital types. Developing systems are also required to be of higher definition, and are sought to be excellent in reproducibility of latent images and high in image quality as being free of toner scatter. Accordingly, the particle diameter of toner is increasingly reduced to cope with such situations.

Toners having a small particle diameter have a large surface area per unit mass, and hence tend to have high electric charges on toner particle surfaces in the step of development. Where a toner tends to have high electric charges on toner particle surfaces, the toner applied on a developer carrying member may have too large charge quantity because of contact with the developer carrying member when the developer carrying member is repeatedly rotated. A phenomenon in which the toner comes to have an excess charge quantity is called a charge-up phenomenon.

Once this charge-up phenomenon occurs, the toner and the developer carrying member surface attract each other because of mirror force that acts therebetween. Hence, the toner comes to stand immobile on the developer carrying member surface to become difficult to move from the developer carrying member to the latent image formed on the photosensitive drum. In particular, this phenomenon tends to occur in an environment of low humidity.

The toner present on the developer carrying member surface in the immobile state makes it difficult for other toner to gain access to the developer carrying member, and as a result, the toner may come to be difficult to charge. For this reason, the toner involved in development decreases, and hence problems are raised such as thin line images, decrease in image density of solid images, sleeve ghosts and density non-uniformity. Such toner not properly charged because of the charge-up may become uncontrollable to flow out on the developer carrying member to cause what is called a blotch phenomenon in which blotchy or wavy non-uniformity comes about on images.

Printers for personal use in homes and offices or for SOHO (small office home office) are often used in a low print percentage and for printing one or a few sheets. Where the number of sheets printed at a time is few (hereinafter also called "intermittent mode"), the developer carrying member is repeatedly rotated in a larger number of times than in continuous printing on a large number of sheets, to tend to cause the above charge-up phenomenon.

As a measure to cope with the charge-up phenomenon on the side of the developer carrying member, Japanese Patent Application Laid-open No. H08-240981 discloses a method in which a developer carrying member is used which is obtained by forming on a metallic substrate a resin coat layer in which a conductive substance or solid lubricant such as carbon black or graphite and conductive spherical carbon particles have been dispersed in a resin. However, this developer carrying member may be insufficient in respect of the performance to provide toner with charges rapidly and uniformly and the ability to provide toner with charges appropriately, because the profile of surface unevenness of the resin coat layer formed on the developer carrying member surface is not sufficiently uniform.

Meanwhile, the main bodies of printers and copying machines are increasingly miniaturized. Personal printers are especially strongly desired to be miniaturized, and not only their main bodies but also their developing assemblies themselves are required to be made compact. With such a trend, their component parts including developer carrying members are also increasingly made small-sized. However, taking notice of a developer carrying member used when a magnetic toner is used, making the developer carrying member smaller is to make the diameter of the developer carrying member smaller, which means that a magnet roller set in the developer carrying member is also made smaller. In this case, with a decrease in diameter of the magnet roller, the magnetic flux density decreases necessarily, and this tends to cause fog greatly in a low-temperature and low-humidity environment.

To cope with such a problem, Japanese Patent Application Laid-open No. 2001-235898 discloses a spherical toner using a magnetic powder containing phosphorus elements. This toner is superior in resolution and in durability in a high-temperature and high-humidity environment. However, there has been room for further improvement when used in the intermittent mode with a low print percentage in a high-temperature and high-humidity environment and a low-temperature and low-humidity environment.

In addition, from the viewpoint of miniaturization, in addition to a method of miniaturizing the main body and component parts of a developing assembly, a low-consumption toner is sought which enables a large number of sheets to be printed in a small quantity. In respect to such a low-consumption toner, it is proposed to make toner particles spherical so as to improve transfer efficiency to achieve the objective. However, in such a toner with particles made spherical, the particle surfaces have been smoothened more than those of conventional pulverization toners, and also a magnetic material may easily be enclosed inside particles. Hence, the toner tends to be unstably charged. This concurrently tends to cause faulty images such as sleeve ghosts, blotch phenomenon and density non-uniformity.

To cope with this problem, Japanese Patent Applications Laid-open No. 2003-57951 and No. 2002-311636 disclose a method in which a quaternary ammonium salt compound capable of charging iron powder positively is added to the resin coat layer of the developer carrying member to prevent a toner subjected to spherical treatment or a negative toner produced by polymerization from being charged in excess. The use of such a method can be effective in preventing the charge-up phenomenon during long-term service and in improving uniformly charging properties. However, if the quaternary ammonium salt is added in a large quantity, the strength of the resin coat layer may be lowered to tend to cause variations of surface roughness.

In general, monochrome printers or copying machines often reproduce letters or characters, where the toner consumption can be cut down by controlling what is called the line toner laid-on level (the toner amount for development with which a line image is formed). However, for example, in an attempt to form line latent images of 200 μm in width and control the toner consumption, there has been such a problem that the line width obtained actually is considerably smaller than 200 μm, resulting in a lowering of the reproducibility of latent images.

In Japanese Patent Application Laid-open No. H01-112253, it is proposed that the toner consumption can be cut down by using a toner having specific fine-powder content, true density and residual magnetization. However, such a toner tends to give a low solid-image density, and an attempt to make the image density higher results in an increase in toner consumption and also makes the lines thicker inevitably. That is, it is sought to keep the image density high and reproduce line images faithfully to latent images while cutting down the toner consumption.

SUMMARY OF THE INVENTION

An object of the present invention is to solve the above problems. More specifically, the present invention aims to provide a developing method and a developing assembly which are able to provide high-grade images without causing any image density decrease or density non-uniformity, sleeve ghosts and fog, even during continuous copying over an extended period of time.

The present invention also aims to provide a developing method and a developing assembly which are able to always uniformly and quickly triboelectrically charge the toner held on the developer carrying member surface and maintain low toner consumption, even during long-term service.

The present invention is a developing method in which a developer held in a developer container is carried on a developer carrying member, and, while a thin layer of the developer is formed on the developer carrying member by the aid of a developer layer thickness control member, the developer is transported to a developing zone facing a latent image bearing member, where a latent image on the latent image bearing member is developed with the developer to render the latent image visible; the developer comprising magnetic toner particles containing at least a binder resin and a magnetic powder; the magnetic powder having a saturation magnetization of 67.0 $Am^2/kg$ or more and 75.0 $Am^2/kg$ or less in a magnetic field of 79.6 kA/m (1,000 oersteds) and having a residual magnetization of 4.5 $Am^2/kg$ or less; and the developer carrying member having at least a substrate and a conductive resin coat layer on the surface of the substrate, and the conductive resin coat layer satisfying, in its surface profile measured by means of a focus optics laser, $1.00 \leqq S/A \leqq 1.65$ where the area of microscopic unevenness regions from which parts exceeding a reference plane by 0.5×r (r: weight average particle diameter (μm) of a toner used) or more have been excluded is represented by A ($m^2$) and the surface area of said microscopic unevenness regions is represented by S ($m^2$)

Further, the present invention is a developing assembly having a developer container which holds a developer therein, a means which carries the developer onto a developer carrying member and forms thereon a thin layer of the developer by the aid of a developer layer thickness control member, a means which transports the thin layer of the developer to a developing zone facing a latent image bearing member, and a means which develops with the developer a latent image formed on the latent image bearing member, to render the latent image visible; the developer comprising magnetic toner particles containing at least a binder resin and a magnetic powder; the magnetic powder having a saturation magnetization of 67.0 $Am^2/kg$ or more and 75.0 $Am^2/kg$ or less in a magnetic field of 79.6 kA/m (1,000 oersteds) and having a residual magnetization of 4.5 $Am^2/kg$ or less; and the developer carrying member having at least a substrate and a conductive resin coat layer on the surface of the substrate, and the conductive resin coat layer satisfying, in its surface profile measured using a focus optics laser, $1.00 \leqq S/A \leqq 1.65$ where the surface of microscopic unevenness regions from which parts exceeding a reference plane by 0.5×r (r: weight average particle diameter (μm) of a toner used) or more have been excluded is represented by A ($m^2$) and the surface area of said microscopic unevenness regions is represented by S ($m^2$).

According to the developing method and developing assembly of the present invention, high-grade images can be obtained without causing any image density decrease or density non-uniformity, sleeve ghosts and fog, even in continuous service over a long period of time. It is also possible to always uniformly and quickly triboelectrically charge the toner held on the developer carrying member surface and maintain a low toner consumption, even during repeated use over an extended period of time.

Further features of the present invention will become apparent from the following description of exemplary embodiments with reference to the attached drawings.

DESCRIPTION OF THE EMBODIMENTS

As a result of studies made by the present inventors, it has been discovered that the magnetic properties of the magnetic powder used in the toner have a great influence on toner consumption, running performance in a high-temperature and high-humidity environment and fog in a low-temperature and low-humidity environment. That is, they have discovered that the toner consumption can be reduced, the running performance in a high-temperature and high-humidity environment can be improved and the fog in a low-temperature and low-humidity environment can be remedied by controlling such magnetic properties to have specific values. In addition, the developer carrying member is provided on its surface with a conductive resin coat layer, and the microscopic unevenness profile of its surface is so controlled as to be smooth and uniform, thereby making it possible for the toner to be charged in a uniform and appropriate quantity. Besides, it is easy for the ears of toner to be uniformly formed on the developer carrying member. In particular, it has been discovered that the effect of reducing toner consumption and preventing spots around line images and fog can be more brought out when a toner as the developer specified in the present invention, i.e., a toner using the magnetic powder having a high saturation magnetization and a low residual magnetization and the above developer carrying member are used in combination.

Figure 1:
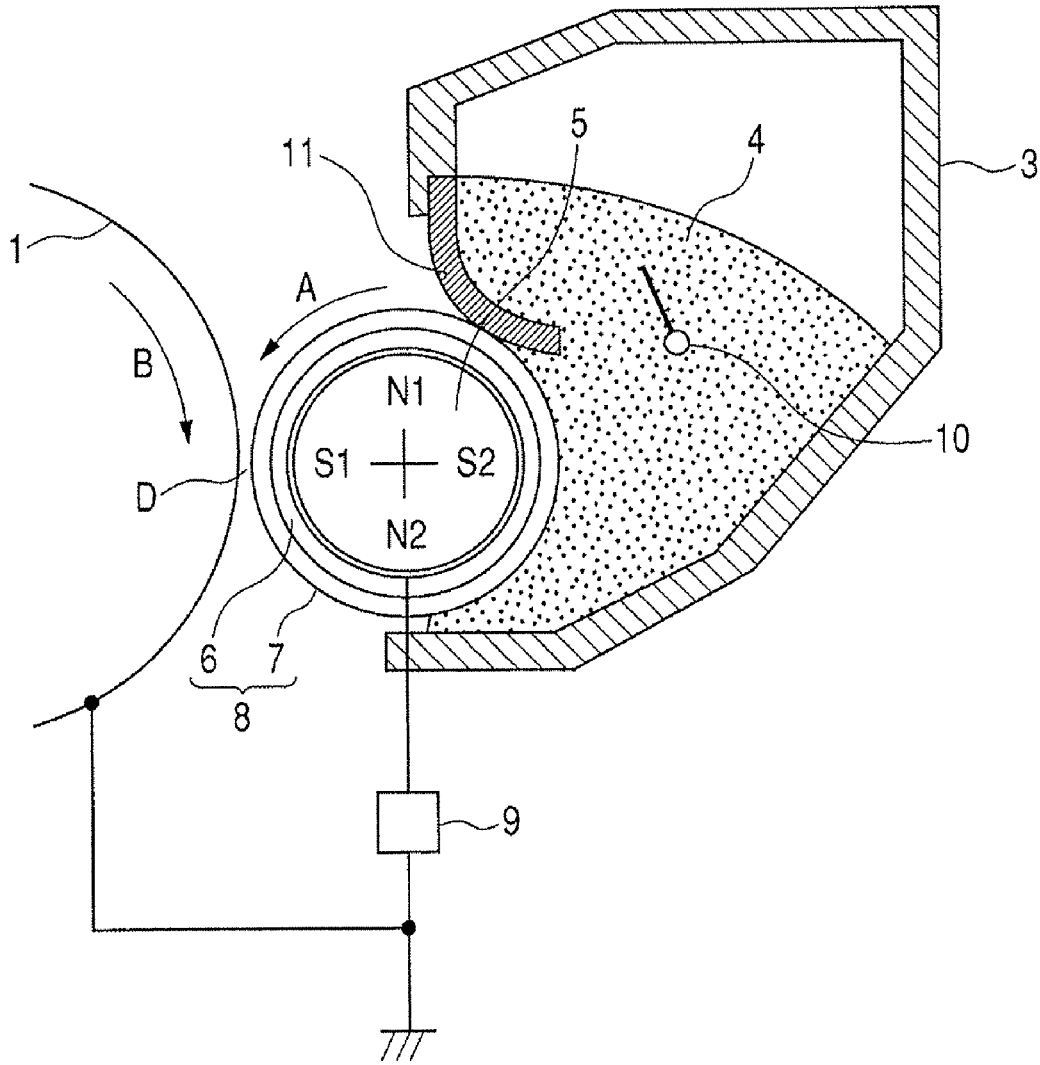
FIG. 1 is a diagrammatic view showing an example of a developing assembly used in an image forming method in the present invention.

First, to describe the developing method and developing assembly, an example of an image forming apparatus having the developer carrying member of the present invention is shown in FIG. 1 including a structure around the developing assembly. An electrostatic latent image bearing member (hereinafter also "photosensitive drum") 1 for holding electrostatic latent images thereon is rotated in the direction of an arrow B. A developing sleeve 8 such as the developer carrying member, which faces the photosensitive drum 1, is constituted of a cylindrical metal tube (hereinafter also "substrate") 6 and a resin coat layer 7 formed on the surface thereof. A developer container 3 is provided therein with an agitation blade 10 which agitates a toner 4 such as a magnetic one-component developer. The magnetic one-component developer (toner), which is fed from the developer container 3 onto the developing sleeve 8, is held on the developing sleeve 8, and is transported as the developing sleeve 8 is rotated in the direction of an arrow A, to a developing zone D at which the developing sleeve 8 faces the photosensitive drum 1. In the interior of the developing sleeve 8, a magnet 5 is provided which is to attract the magnetic one-component developer (toner) 4 magnetically to, and hold it on, the developing sleeve 8. The magnetic one-component developer (toner) 4 is triboelectrically charged by friction with the developing sleeve 8 and/or a developer layer thickness control member such as an elastic blade 11 to thereby enable the electrostatic latent images formed on the photosensitive drum 1 to be developed.

A thin layer of the magnetic one-component developer (toner) 4 formed on the developing sleeve 8 by the aid of the elastic blade 11 may preferably be much thinner than the minimum gap between the developing sleeve 8 and the photosensitive drum 1 at the developing zone D. That is, the present invention is especially effective in a developing assembly of a system in which electrostatic latent images are developed with such a toner thin layer, i.e., what is called a non-contact type developing assembly. To the developing sleeve 8, a development bias voltage is applied from a power source 9 in order that the magnetic one-component developer (toner) 4 held on the developing sleeve 8 can be attracted. When a direct-current voltage is used as this development bias voltage, it is preferable to apply to the developing sleeve 8 a voltage having an intermediate value between the potential at image areas of electrostatic latent images (i.e., areas to which the toner adhere to render the latent images visible) and the potential at background areas. On the other hand, an alternating bias voltage may be applied to the developing sleeve 8 to form an oscillating electric field whose direction to the developing zone is alternately reversed, in order for developed images to have a high density or to improve their gradations. In this case, an alternating bias voltage formed by superimposing a direct-current voltage component having an intermediate value between the potential at image areas and the potential at background areas as described above is applied to the developing sleeve 8.

In what is called regular development, in which a toner adheres to high-potential areas of an electrostatic latent image bearing member having high-potential areas and low-potential areas, to render electrostatic latent images visible, a toner is used which is chargeable to a polarity reverse to the polarity of the electrostatic latent images. On the other hand, in what is called reverse development, in which a toner adheres to the low-potential areas to render electrostatic latent images visible, a toner is used which is chargeable to the same polarity as the polarity of the electrostatic latent images. Here, what are referred to as high potential and low potential are in terms of absolute values. In any case, the magnetic one-component developer (toner) 4 is charged by friction with the developing sleeve 8 to a polarity for developing electrostatic latent images.

Figure 2:
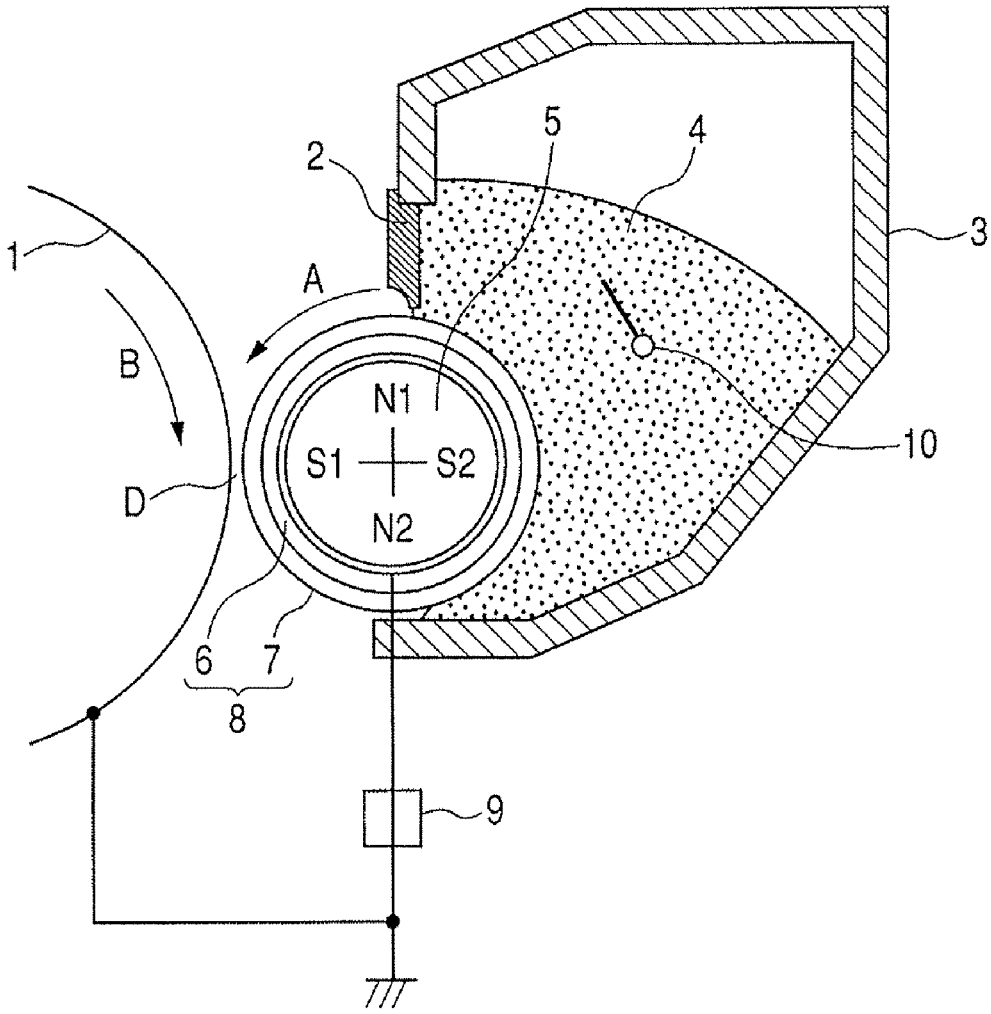
FIG. 2 is a diagrammatic view showing an example of a developing assembly used in an image forming method in the present invention.

What controls the layer thickness of the magnetic one-component developer (toner) 4 on the developing sleeve 8 is not necessarily required to be the elastic blade 11. Instead, a developer layer thickness control member such as a magnetic blade 2 set opposite to a magnet 5 may be used as shown in FIG. 2. In this case, as the developing sleeve 8, a member is used in which particles to be carried thereon are beforehand carried on the resin layer. As a gap between the magnetic blade 2 and the developing sleeve 8, it is usually from 50 to 500 μm. In FIG. 2, magnetic lines of force coming from an N1 pole of the magnet 5 converge on the magnetic blade 2, whereby a thin layer of the magnetic one-component developer (toner) 4 is formed on the developing sleeve 8.

As shown in FIG. 1, in the interior of the developing sleeve 8, the magnet 5 is so fixed as to be concentric to the developing sleeve 8. The magnet 5 has a plurality of magnetic poles as shown in the drawing, where S1 is involved with development; N1, regulation of toner coat level; S2, take-in and transport of the toner; and N2, discharge of the toner.

Here, referring to the residual magnetization of the magnetic powder, where the residual magnetization is high, the toner discharged at the N2 pole is inferior in fluidity because of magnetic cohesion. As being clear from FIG. 1, from the N2 pole to the S2 pole, the toner is in the state that it tends to be packed for a physical reason as well because the toner is fed through a toner feed member such as an agitation blade 10 of a cartridge. Thus, the toner tends to deteriorate because the pressure of packing is applied in addition to the magnetic cohesion. In particular, in the intermittent mode with a low print percentage in a high-temperature and high-humidity environment, it follows that the toner is not consumed and besides the pressure of packing continues being applied, so that the toner tends to deteriorate, e.g., external additives may become buried in toner particles. For this reason, from the viewpoint of not easily causing the magnetic cohesion, the lower the residual magnetization of the magnetic powder is, the more preferable. In the present invention, the magnetic powder must have a residual magnetization of 4.5 $Am^2/kg$ or less, and preferably 4.0 $Am^2/kg$ or less.

Where the residual magnetization of the magnetic powder is reduced, its saturation magnetization is also reduced. Hence, the fog may greatly occur if the residual magnetization of the magnetic powder is simply reduced. Such a tendency becomes stronger especially when a small-diameter developer carrying member is used, and the fog tends to greatly occur in a low-temperature and low-humidity environment.

For this reason, the saturation magnetization of the toner must be increased to keep the fog from occurring by the aid of magnetic binding force. Specifically, in the present invention, it is important for the magnetic powder to have a saturation magnetization of 67.0 $Am^2/kg$ or more in an external magnetic field of 79.6 kA/m. On the other hand, it is very difficult for the magnetic powder to have a saturation magnetization of more than 75.0 $Am^2/kg$ as its residual magnetization is reduced. Considering that the magnetic powder contains no transition metal other than an iron element, it is essential that the saturation magnetization of the magnetic powder is 67.0 $Am^2/kg$ or more and 75.0 $Am^2/kg$ or less, and preferably 68.0 $Am^2/kg$ or more and 75.0 $Am^2/kg$ or less.

In the present invention, it is preferable for the magnetic powder to contain substantially no transition metal other than the iron element. The above "substantially no transition metal" means that no transition metal other than the iron element is intentionally added when the magnetic powder is produced, and that transition metals other than the iron element may be included as impurities in a content of 1.0% or less, and more preferably 0.5% or less, in total based on the iron element.

Various studies have been made in order to obtain the magnetic powder having such magnetic properties. As a result, it has been found that, as one method, the magnetic powder may preferably be incorporated with a phosphorus element in an amount of from 0.05 to 0.25% by mass based on the iron element and with a silicon element in an amount of from 0.30 to 0.80% by mass based on the iron element. It has been found that it is further preferable for the magnetic powder to have the phosphorus element and the silicon element in a proportion (P/Si) of from 0.15 to 0.50.

Although the reason therefore is not clear, the present inventors consider that by using the specific amounts of the phosphorus element and silicon element in the specific proportion, the phosphorus element and silicon element come to be present in a special state in crystal lattices ($Fe_2O_3$) of the magnetic powder so that the magnetic powder can have such magnetic properties.

If the phosphorus element is in an amount of less than 0.05% by mass, it is difficult for the magnetic powder to have a low residual magnetization. If it is in an amount of more than 0.25% by mass, the magnetic powder has a broad particle size distribution and also it may be difficult to control its particle diameter. This applies alike to the silicon element as well. If the silicon element is in an amount of less than 0.3% by mass, it is difficult for the magnetic powder to have a low residual magnetization. If it is in an amount of more than 0.8% by mass, the magnetic powder has a broad particle size distribution and the dispersibility of the magnetic powder in toner particles may be lowered. Hence, this tends to cause fog greatly.

In addition, if the phosphorus element and the silicon element are in a proportion (P/Si) of less than 0.15, although the magnetic powder can have a low residual magnetization, it may have a low saturation magnetization in parallel. If on the other hand the phosphorus element and the silicon element are in a proportion (P/Si) of more than 0.50, the magnetic powder may have so broad particle size distribution as to result in poor dispersibility in toner particles.

In the present invention, the particle size distribution of the magnetic powder is expressed as volume average variation coefficient. In the present invention, the magnetic powder may preferably have a volume average variation coefficient of 30 or less. It is meant that the smaller the value of the volume average variation coefficient, the sharper the particle size distribution is. The volume average variation coefficient is defined according to the following expression.

Volume average variation coefficient=[standard deviation of particle size distribution of magnetic powder/volume average particle diameter of magnetic powder ($Dv$)]×100.

It is preferable for the magnetic powder to have a volume average particle diameter (Dv) of 0.15 μm or more and 0.35 μm or less. In general, the coloring power can be higher as the volume average particle diameter (Dv) of the magnetic powder is smaller, but the magnetic powder tends to agglomerate and has a poor uniform dispersibility in toner particles, which is undesirable. Further, a magnetic powder having a small volume average particle diameter (Dv) tends to have a high residual magnetization, and hence it is preferable for the magnetic powder to have the Dv of 0.15 μm or more.

On the other hand, a magnetic powder having a volume average particle diameter (Dv) of more than 0.35 μm can be made to have a low residual magnetization, but may simultaneously have a low saturation magnetization as well. Further, the uniform dispersion may be difficult to achieve in a suspension polymerization process which is a preferable process for producing the toner in the present invention. Hence, it is preferable for the magnetic powder to have a volume average particle diameter (Dv) of 0.15 μm or more and 0.35 μm or less, and more preferably from 0.15 μm or more and 0.30 μm or less.

The volume average particle diameter (Dv) may be measured with a transmission electron microscope (TEM). In that measurement, the magnetic powder may be observed on the transmission electron microscope to determine the volume average particle diameter, or the volume average particle diameter of the magnetic powder may be determined from a sectional photograph of toner particles. As a specific method of determining the volume average particle diameter (Dv) of the magnetic powder, circle-equivalent diameters are determined which are equal to projected areas of 100 particles of the magnetic powder which are present in the visual field on a photograph taken at magnifications of 10,000 to 40,000, and the volume average particle diameter is calculated on the basis thereof.

In the case where the volume average particle diameter of the magnetic powder is determined from the sectional photograph of toner particles, the toner particles to be observed are sufficiently dispersed in a cold curing epoxy resin, followed by curing for 2 days in an atmosphere at a temperature of 40° C. to obtain a cured product, which is then made into a thin-piece sample by means of a microtome. The sample obtained is photographed on a transmission electron microscope (TEM), and the volume average particle diameter is determined by the method described above.

The toner using such a magnetic powder enables the toner consumption to be reduced. Studies have been made in variety on the toner consumption. As a result, it has been found that the toner consumption correlates with the level of toner laid on at line areas of images, and hence the level of toner laid on (toner laid-on level) at line areas can be reduced, whereby the toner consumption decreases.

Referring to magnetic one-component development, it has fairly been difficult to control the toner laid-on level while keeping a line width constant. The reason therefor is that in the developing zone, toner behaves not as particles but as "ears" formed by a plurality of particles. That is, the reduction of the toner consumption makes it difficult to keep a line width constant, and hence toner has been used for development in a quantity more than necessary for filling out latent images. This tendency is remarkable in jumping development in which what is called the edge effect comes about (a phenomenon in which electric charges concentrate on edge portions of lines to cause an increase in the amount of toner for development at the edge portions), where it has been very difficult to control the toner laid-on level while keeping a line width constant.

However, in the case of the magnetic toner used in the present invention, i.e., the magnetic toner containing the magnetic powder having a high saturation magnetization and a low residual magnetization, uniform ears can be formed on the developer carrying member. Such uniform ears are attracted from the developer carrying member to the latent image bearing member at the developing zone when a development bias is applied. Since the toner in the present invention has a low residual magnetization as described previously, the ears of the toner have been collapsed at the developing zone, and the toner can behave as individual one-by-one particles. Hence, it does not come about that the toner is unnecessarily much supplied to development, and hence the toner laid-on level can be reduced. Because of such small toner laid-on level and a low residual magnetization, the spots around line images can also be minimized.

As described above, the volume average particle diameter and magnetic properties of the magnetic powder and the amount and proportion of the elements contained are suitably balanced, thus it is possible to achieve both the running performance in a high-temperature and high-humidity environment and the prevention of fog in a low-temperature and low-humidity environment. Further, the toner laid-on level can be controlled even in the same line width, and the toner consumption can concurrently be reduced.

In the present invention, the intensity of magnetization of the magnetic toner is measured with a vibration type magnetic-force meter VSM P-1-10 (manufactured by Toei Industry, Co., Ltd.) under the application of an external magnetic field of 79.6 kA/m at room temperature of 25° C.

The magnetic powder used in the present invention may preferably have a 50% volume diameter of from 0.5 μm to 1.5 μm, and more preferably from 0.5 μm to 1.1 μm, in styrene/n-butyl acrylate, and have an SD value of 0.4 μm or less which is represented by the following expression (2).

$$SD=(d84\%-d16\%)/2 \quad (2)$$

wherein d16% represents a particle diameter at which a cumulative value comes to be 16% by volume in volume-based particle size distribution, and d84% represents a particle diameter at which a cumulative value comes to be 84% by volume.

In the suspension polymerization process (detailed later), which is a preferable process in the present invention, the magnetic powder must be dispersed in a polymerizable monomer including styrene. Hence, in order to improve the uniform dispersibility of the magnetic powder in toner particles, it is important that the particle size of the magnetic powder is fine and the particle size distribution is sharp, at the time of dispersion into the polymerizable monomers. Studies have been made from this standpoint. As a result, it has been found that, as long as the magnetic powder has a 50% volume diameter of 1.5 μm or less (more preferably 1.1 μm or less) in styrene/n-butyl acrylate, the magnetic powder is substantially uniformly dispersed in toner particles, and the distribution of the magnetic powder in the toner particles can be nearly uniform. Furthermore, where the SD value represented by the expression (1) is 0.4 μm or less, i.e., the particle size distribution in the styrene/n-butyl acrylate is sharp, the effect of improving the dispersibility of the magnetic powder in toner particles can be very great. Thus, such an SD value is more preferred.

On the other hand, in order for the magnetic powder to have a 50% volume diameter of less than 0.5 μm, it must be dispersed for a very long time and also strong shear must be applied, undesirably resulting in very poor productivity.

The 50% volume diameter in styrene/n-butyl acrylate and SD value of the magnetic powder are measured in the following way.

29.6 g of styrene and 10.4 g of n-butyl acrylate are put into a 150 ml glass bottle, which is attached to an equipment DISPERMAT (manufactured by VMA GETZMANN GMBH). Next, a disk of 30 mm in diameter is attached to the equipment DISPERMAT, and 36 g of the magnetic powder is introduced thereinto over a period of 1 minute with stirring at 600 ppm. Thereafter, the number of revolutions is raised to 4,000 rpm, and retained for 30 minutes. Immediately after the completion of the stirring, the dispersion slurry thus obtained is measured using MICROTRACK (manufactured by Nikkiso Co., Ltd.), and the 50% volume diameter (μm) and the SD value (μm) are determined.

The magnetic powder used in the magnetic toner in the present invention may be produced by, e.g., the following method.

To an aqueous ferrous salt solution, an alkali such as sodium hydroxide is added in an equivalent weight, or more than equivalent weight, based on the iron component, a phosphoric-acid compound such as sodium phosphate is so added that the phosphorus element may be in an amount of from 0.05 to 0.25% by mass based on the iron element, and a silicon compound such as sodium silicate is so added that the silicon element may be in an amount of from 0.30 to 0.80% by mass based on the iron element, to prepare an aqueous solution containing ferrous hydroxide. Into the aqueous solution thus prepared, air is blown while the pH of the solution is maintained at pH 7 or above, and the ferrous hydroxide is allowed to undergo oxidation reaction while the aqueous solution is heated at 70° C. or above to first form seed crystals serving as cores of magnetic iron oxide particles.

Next, to a slurry-like liquid containing the seed crystals, an aqueous solution containing ferrous sulfate in about one equivalent weight on the basis of the amount of the alkali added previously is added. The reaction of the ferrous hydroxide is continued while the pH of the liquid is maintained at 5 to 10 and air is blown, to cause magnetic iron oxide particles to grow around the seed crystals as cores. At this point, any desired pH, reaction temperature and stirring conditions may be selected to control the particle shape and magnetic properties of the magnetic powder. After the oxidation reaction has been completed, the particle surfaces of the magnetic powder are subjected to hydrophobic treatment. Where such surface treatment is carried out by a dry process, the magnetic material obtained after washing, filtration and drying is subjected to treatment with a coupling agent. Where the surface treatment is carried out by a wet process, those having been dried after the oxidation reaction has been completed are again dispersed. Alternatively, the iron oxide material obtained by washing and filtration after completing the oxidation reaction may be dispersed again in a different aqueous medium without being dried, and the pH of the resulting dispersion may be adjusted to a acid region, where a silane coupling agent may be added with thorough stirring, and the temperature may be raised after hydrolysis, or the pH may be adjusted to an alkaline region, followed by coupling treatment. However, in order to obtain the magnetic powder having a 50% volume diameter of 1.5 μm or less in styrene/n-butyl acrylate and an SD value of 0.4 μm or less, which are preferred requirements of the present invention, it is preferable that the iron oxide material obtained by filtration and washing after completing the oxidation reaction, as it is, is made into a slurry without being dried, and then the surface treatment is carried out.

To carry out treatment by the wet process, i.e., with a coupling agent in an aqueous medium, as the surface treatment of the magnetic powder, the magnetic powder is first sufficiently dispersed in the aqueous medium so as to become primary particles, and then stirred with a stirring blade or the like so as not to settle or agglomerate. Next, the coupling agent is introduced in any desired amount, and the surface treatment is carried out while hydrolyzing the coupling agent. It is more preferable to perform the surface treatment while sufficiently carrying out dispersion so as not to cause agglomeration, with stirring and using an apparatus such as a pin mill or a line mill.

The aqueous medium is meant to be a medium composed chiefly of water. Specifically, it may include water itself, water to which a surface-active agent has been added in a small quantity, water to which a pH adjuster has been added, and water to which an organic solvent has been added. As the surface-active agent, nonionic surface-active agents such as polyvinyl alcohol are preferred. The surface-active agent may be added in an amount of from 0.1 to 5.0% by mass based on the water. The pH adjuster may include inorganic acids such as hydrochloric acid. The organic solvent may include alcohols.

The magnetic powder thus treated is further subjected to washing, filtration and drying, where drying conditions and disintegration conditions must be so determined as to allow the magnetic powder to have the 50% volume diameter in styrene/n-butyl acrylate and the SD value as described above. A silane compound may be used for the surface treatment of the magnetic powder, and besides a titanium compound may also be used.

In the step of drying, if drying temperature is low, the coupling agent may melt because of the low binding strength between the coupling agent used for surface-treatment and the magnetic powder particle surfaces, so that the magnetic powder particle surfaces may come exposed. Hence, it may result in a large 50% volume diameter in styrene/n-butyl acrylate, and also result in a large SD value.

If on the other hand the drying temperature is high, the magnetic powder may agglomerate during the drying, undesirably resulting in a large 50% volume diameter in styrene/n-butyl acrylate.

The magnetic powder used in the magnetic toner of the present invention is composed primarily of iron oxide such as triiron tetraoxide or γ-iron oxide, and, in addition thereto, may contain, besides the phosphorus and silicon elements, any of elements such as cobalt, nickel, copper, magnesium, manganese and aluminum which may be used alone or in combination of two or more types.

As the particle shape of the magnetic powder, it may be polyhedral (e.g., octahedral or hexahedral), spherical, acicular or flaky. In particular, it may preferably be spherical.

The silane compound used in the present invention may preferably be a compound represented by the following formula (1).

$$R_mSiY_n \quad (1)$$

wherein R represents an alkoxyl group; m represents an integer of 1 to 3; Y represents a hydrocarbon group such as an alkyl group, a vinyl group, a glycidoxyl group or a methacrylic group; and n represents an integer of 1 to 3; provided that m+n=4.

The silane coupling agents represented by the chemical formula (1) may include the following: Vinyltrimethoxysilane, vinyltriethoxysilane, vinyltris(β-methoxyethoxy)silane, β-(3,4-epoxycyclohexyl)ethyltrimethoxysilane, γ-glycidoxypropyltrimethoxysilane, γ-glycidoxypropylmethyldiethoxysilane, γ-aminopropyltriethoxysilane, N-phenyl-γ-aminopropyltrimethoxysilane, γ-methacryloxypropyltrimethoxysilane, vinyltriacetoxysilane, methyltrimethoxysilane, dimethyldimethoxysilane, phenyltrimethoxysilane, diphenyldimethoxysilane, methyltriethoxysilane, dimethyldiethoxysilane, phenyltriethoxysilane, diphenyldiethoxysilane, n-butyltrimethoxysilane, isobutyltrimethoxysilane, trimethylmethoxysilane, n-hexyltrimethoxysilane, n-octyltrimethoxysilane, n-octyltriethoxysilane, n-decyltrimethoxysilane, hydroxypropyltrimethoxysilane, n-hexadecyltrimethoxysilane and n-octadecyltrimethoxysilane.

Of these, from the viewpoint of achievement of high hydrophobicity, an alkyltrialkoxysilane compound represented by the following formula (2) may preferably be used.

$$C_pH_{2p+1}—Si—(OC_qH_{2q+1})_3 \quad (2)$$

wherein p represents an integer of 2 to 20, and q represents an integer of 1 to 3.

In the above formula, if p is smaller than 2, it is difficult to provide a sufficient hydrophobicity. If p is larger than 20, though hydrophobicity can be sufficient, the magnetic powder particles may greatly coalesce one another, which is undesirable.

In addition, if q is larger than 3, the silane compound may have a low reactivity to make it hard for the magnetic powder to be made sufficiently hydrophobic. Accordingly, it is good to use an alkyltrialkoxysilane compound in which the p in the formula represents an integer of 2 to 20 (more preferably an integer of 3 to 15) and the q represents an integer of 1 to 3 (more preferably an integer of 1 or 2).

In the case where the above silane compound is used, the treatment may be carried out using it alone, or using a plurality of types in combination. When used in combination, the treatment may be carried out using the respective coupling agents separately, or the treatment may be carried out using them simultaneously. The silane compound used may preferably be in a total treatment quantity of from 0.9 to 3.0% by mass, and more preferably from 0.9 to 2.5% by mass, based on 100 parts by mass of the magnetic powder. Furthermore, it is important to control the amount of the treating agent in accordance with the surface area of the magnetic powder, the reactivity of the silane compound, and so forth.

In the present invention, the silane compound may preferably be in a liberation percentage of from 3% to 30%, and more preferably from 3% to 20%, which is found from the following expression (3).

$$\text{Liberation percentage}=\{1-[(\text{the level of the silane compound the magnetic powder contains after dispersed in toluene for 60 minutes})/(\text{the coverage of the silane compound the magnetic powder contains})]\}\times 100 \quad (3)$$

In the present invention, the liberation percentage indicates the proportion of the silane compound that melts out from the magnetic powder. It is meant that, as this value is larger, the magnetic powder has been treated with the silane compound in a necessary and minimum level. As a result of studies made by the present inventors, the level of the silane compound the magnetic powder has after it has been dispersed in toluene depends substantially on the type and specific surface area of the magnetic powder. Thus, if the magnetic powder is treated with the silane compound in a level smaller than this level, it may have a low degree of hydrophobicity and also a poor dispersibility.

However, it is unavoidable for the degree of hydrophobicity to somewhat decrease even when treated with the silane compound in a necessary and minimum level. Thus, it has turned out that it is necessary to carry out the treatment in a level slightly larger than the necessary and minimum silane compound treatment level, and, as long as the silane compound is in a liberation percentage of 3% or more, it may result in neither a lowering of the degree of hydrophobicity nor faulty dispersion.

On the other hand, if the silane compound is in a liberation percentage of more than 30%, the magnetic powder tends to be a little agglomarative, which is undesirable. In addition, such a magnetic powder tends to undesirably cause a lowering of charge quantity of the toner.

A specific method for measuring the liberation percentage is as follows:

1 g of a magnetic powder calcined at 500° C. is heated and dissolved in 10 ml of concentrated hydrochloric acid. Thereafter, pure water is added to make the total weight 100 ml (hereinafter this solution is called a mother liquor). A portion of 20 ml is taken from the mother liquor, and pure water is added to make the total weight 100 ml to prepare a solution (for measurement). A portion of 20 ml is further taken from the mother liquor, and a silica reference liquid for atomic spectrophotometry is added in a given amount. Thereafter, pure water is added to bring the total weight into 100 ml to prepare a solution (for standardization).

Next, the Si level (mg) in the measuring solution is determined by the standard addition method, using an ICP emission spectrophotometer (trade name: Vista-PRO; manufactured by Seiko Instruments Inc.), and the Si level (% by mass) of the magnetic powder is calculated.

An Si level the magnetic powder having been subjected to hydrophobic treatment with the silane compound has is represented by Si-1, and an Si level the magnetic powder having not been subjected to hydrophobic treatment with the silane compound has is represented by Si-2.

20.0 g of the magnetic powder having been subjected to hydrophobic treatment with the silane compound and 13.0 g of toluene are put into a 50 ml screwed pipe bottle, and shaken, followed by irradiation with ultrasonic waves for 60 minutes by means of an ultrasonic dispersion machine. Thereafter, centrifugation is carried out for 15 minutes at 2,000 rpm by using a centrifugal separator, followed by removing the supernatant liquid to obtain precipitate. The precipitate obtained is dried at 90° C. for 1 hour, and thereafter an Si level (Si-3) the magnetic powder has is measured by the above method.

The value found by subtracting Si-2 from Si-1 is the level of coverage the silane compound the magnetic powder contains, and the value found by subtracting Si-2 from Si-3 is the level of the silane compound the magnetic powder contains after dispersed in toluene for 60 minutes. Using these, the liberation percentage is found according to the above expression (3).

In the magnetic toner used in the present invention, in addition to the magnetic powder, other colorants may also be used in combination. Such a colorant usable in combination may include magnetic or non-magnetic inorganic compounds and known dyes and pigments. Specifically, it may include the following: Ferromagnetic metal particles of cobalt, nickel and the like, or particles of alloys of any of these metals to which chromium, manganese, copper, zinc, aluminum, a rare earth element or the like has been added, as well as particles of hematite or the like; and titanium black, nigrosine dyes or pigments, carbon black, and phthalocyanines. These may also be used after subjected to surface treatment.

The magnetic powder used in the magnetic toner in the present invention may preferably be used in an amount of from 20 to 150 parts by mass based on 100 parts by mass of the binder resin. It may more preferably be used in an amount of from 30 to 140 parts by mass. If it is less than 20 parts by mass, the toner, though having good fixing performance, may be inferior in coloring power, making it difficult to keep fog from occurring. If on the other hand it is more than 150 parts by mass, the magnetic toner may have a poor fixing performance and also be held on the toner-carrying member by magnetic force so strongly as to undesirably have a low developing performance.

The content of the magnetic powder in the toner particles may be measured with a thermal analyzer TGA7, manufactured by Perkin-Elmer Corporation. Referring to a measuring method, the toner is heated at a heating rate of 25° C./minute from normal temperature to 900° C. in an atmosphere of nitrogen. A loss in quantity (mass %) in the course of from 100° C. to 750° C. is regarded as binder resin weight, and residual weight is approximately regarded as magnetic powder weight.

In the magnetic toner usable in the present invention, it is preferable that toner particles in which at least 70% by number of iron oxide contained in individual toner particles is present in a depth 0.2 times as deep as the projected-area-equivalent diameter C from the surface of each of toner particles observed are contained in a proportion of 40% by number or more and 95% by number or less when sections of the toner particles are observed using a transmission electron microscope (TEM).

More specifically, the above condition means that it is preferable that toner particles having a structure in which a magnetic material such as iron oxide is present in a concentrated manner, very close to the surfaces of toner particles, are present in a certain quantity. The toner is so made up as to have such a magnetic-material capsule structure that the toner particles are substantially covered with the magnetic material in that way (hereinafter referred to also as "magnetic-material intermediate layer"), whereby the rigidity of the toner particles are drastically improved. Hence, it is possible that a wax or a resin having a low molecular weight and/or a low glass transition temperature (Tg) is enclosed in the interiors of toner particles in a larger quantity than ever. Thus, the fixing performance can be improved, and besides, external additives embedded in the interiors of toner particles are reduced, and hence the durability of the toner particles can be improved.

If, in the toner particles having the above magnetic-material intermediate layers, the toner particles in which at least 70% by number of iron oxide is present in a depth 0.2 time as deep as the projected-area-equivalent diameter C from the surfaces of toner particles are contained in a proportion of less than 40% by number, the state of presence of the magnetic material tends to become scattered because of an insufficient magnetic-material capsule structure, so that, e.g., the deterioration of external additives on the toner particle surfaces may be accelerated to bring about a lowering of developing performance during long-term service.

On the other hand, if, in the toner particles having the above magnetic-material intermediate layers, the toner particles in which at least 70% by number of iron oxide is present in a depth 0.2 times as deep as the projected-area-equivalent diameter C from the surface of each of toner particles are contained in a proportion of more than 95% by number, it follows that leak sites of electric charges produced by triboelectric charging are present in a large number in the vicinity of the toner particle surfaces, so that the electric charges may tend to escape from the toner particle surfaces to make it unable to sufficiently provide the toner with charges.

In the present invention, as a specific observation method used when the distribution of magnetic fine iron oxide particles in the toner particles is measured by TEM (transmission electron microscopy), a method is preferred in which the particles to be observed is sufficiently dispersed in a cold-curing epoxy resin and thereafter the cured product obtained by curing carried out for two days in an atmosphere of 40° C. temperature is observed as it is, or after it has been frozen, as a thin-piece sample prepared using a microtome having a diamond cutter.

As to the distribution of magnetic fine iron oxide particles in the toner particles, it is measured in the following way. First, the number of magnetic fine iron oxide particles in the applicable toner particles is found by counting magnetic fine iron oxide particles present outside a depth 0.2 times as deep as the circle-equivalent diameter from the surface of each of toner particles. The micrograph used here may preferably be of from 10,000 to 20,000 magnifications in order to make a measurement at a high precision. In the present invention, a transmission electron microscope (H-600 Model, manufactured by Hitachi Ltd.) is used as an instrument. The particles are observed at an accelerating voltage of 100 kV, and observed on a micrograph of 10,000 magnifications to make measurement.

The circle-equivalent diameter is found from the sectional area of each toner particle observed on the micrograph, and this is regarded as the "projected-area-equivalent diameter C". Of these particles, 100 particles included within the range of ±10% of the weight average particle diameter determined by the method described later using a Coulter counter are picked up as evaluation particles. The distribution of iron oxide particles present in the section of each particle of the evaluation particles is observed, and the number of particles is counted in respect of toner particles in which iron oxide particles present in a depth 0.2 times as deep as the circle-equivalent diameter from the surface of each particle account for 70% by number or more (iron oxide distribution).

Where the toner in the present invention is produced by a direct polymerization process carried out in an aqueous medium, it is preferable that the above hydrophobic, magnetic fine iron oxide particles are used and a polar compound added to a polymerizable monomer composition is used. Especially in the present invention, the use of the polar compound in a trace quantity enables the state of presence of the magnetic fine iron oxide particles in toner particles to be controlled, and in addition thereto enables even the stability of droplets during polymerization to be improved. This makes the particle size distribution sharp, and hence, is further preferable in view of yield.

Specifically, it is preferable to use a polar compound having a saponification value of from 20 to 200. The addition of such a polar compound in the system of direct polymerization in an aqueous medium makes it easy that the magnetic material uniformly dispersed inside the droplets of the monomer composition granulated in the aqueous medium is allowed to locally precipitate in the vicinity of particle surface.

The polar compound having a saponification value of from 20 to 200 usable for the toner in the present invention may include the following: Resins having a carboxylic acid derivative group such as acrylic acid, methacrylic acid or abietic acid or having a sulfur type acid group such as sulfonic acid, or modified products thereof, all of which may be used. Specific monomer components constituting such resins may include acrylates such as methyl acrylate, ethyl acrylate, n-butyl acrylate, iso-butyl acrylate, n-propyl acrylate, n-octyl acrylate, dodecyl acrylate, 2-ethylhexyl acrylate, stearyl acrylate, 2-chloroethyl acrylate and phenyl acrylate; methacrylates such as methyl methacrylate, ethyl methacrylate, n-butyl methacrylate, iso-butyl methacrylate, n-propyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; maleic acids such as maleic anhydride and maleic half ester; compounds having a sulfur type acid group such as sulfonic acid; and abietic acid.

Of these polar compounds, a resin having a maleic acid component is preferred because it can be effective in a trace quantity and also it does not cause any lowering of the charging performance of toner and is superior in compatibility with the binder resin. In particular, a maleic anhydride copolymer having a repeating unit(s) represented by the following formula(s) (4) and/or (5), or a ring-opened compound thereof, is preferred, which further bring about the effect of the present invention.

(4)

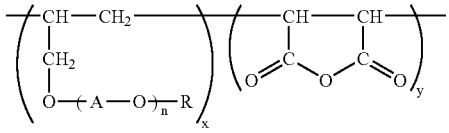

(5)

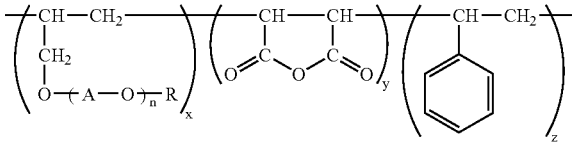

In the formulas (4) and (5) each, A represents an alkylene group, R represents a hydrogen atom or an alkyl group having 1 to 20 carbon atoms, n represents an integer of 1 to 20, and x, y and z each represents a numeral of the copolymerization ratio of the respective components.

In the formula (4), x:y may preferably be from 10:90 to 90:10, and more preferably from 20:80 to 80:20, in molar %.

In the formula (5), x:y may preferably be from 10:90 to 90:10, and more preferably from 20:80 to 80:20, in molar %; and (x+y):z may preferably be from 50:50 to 99.9:0.1, and more preferably from 80:20 to 99.5:0.5, in molar %.

In the formulas (4) and (5), x, y and z are used to represent the copolymerization ratio of the respective components as described above, and the formulas (4) and (5) are intended to represent not only a copolymer in which homopolymers formed by polymerizing x of the first units bond with homopolymers formed by polymerizing y of the second units, but also a copolymer in which the first to third units are copolymerized at random.

The content of the polar compound in the toner may preferably be from 0.001 to 10 parts by mass, more preferably from 0.001 to 1 part by mass, and still more preferably from 0.005 to 0.5 parts by mass, based on 100 parts by mass of the binder resin. If the polar compound is in a content of less than 0.001 parts by mass, the effect to be exhibited by the addition of the polar compound is not brought out. If it is in a content of more than 10 parts by mass, the absolute value of the charge quantity of the toner is apt to decrease because of a leak of electric charges to tend to cause fog and a lowering of image density during long-term service.

The saponification value of the polar compound is determined in the following way. Basic operation is conducted according to JIS K 0070.

(i) Reagent (a) Solvent: An ethyl ether/ethyl alcohol mixture solution (1+1 or 2+1) or a benzene/ethyl alcohol mixture solution (1+1 or 2+1) is used. These solutions are each kept neutralized with a 0.1 mol/litter potassium hydroxide ethyl alcohol solution using phenolphthalein as an indicator immediately before use.

(b) Phenolphthalein solution: 1 g of phenolphthalein is dissolved in 100 ml of ethyl alcohol (95 vol. %).

(c) 0.1 mol/litter potassium hydroxide/ethyl alcohol solution: 7.0 g of potassium hydroxide is dissolved in water used in a quantity as small as possible, and ethyl alcohol (95 vol. %) is added thereto to make up a 1 liter solution, which is then left for 2 or 3 days, followed by filtration. Standardization is carried out according to JIS K 8006 (basic items concerning neutralization titration in a reagent content test).

(ii) Operation: 1 to 20 g of the polar compound as a sample is precisely weighed, and 100 ml of the solvent and few drops of the phenolphthalein solution as an indicator are added thereto, which are then thoroughly shaken until the sample are completely dissolved. In the case of a solid sample, it is dissolved by heating on a water bath. After cooling, to the resultant solution, 100 to 200 ml of the 0.1 mol/litter potassium hydroxide ethyl alcohol solution is added, followed by reflux with heating for 1 hour to effect saponification, and thereafter cooling. The solution obtained is reversely titrated with an aqueous 0.1 mol/litter hydrochloric acid solution, and when pale pink of the indicator has continued to disappear for 30 seconds, it is regarded as the end point of neutralization. A blank test is conducted in parallel to the main test.

(iii) Calculation: The saponification value is calculated according to the following equation.

$$A=(B-C)\times 5.611\times f/S$$

wherein;

A: the saponification value (mgKOH/g);

B: the amount (ml) of the aqueous 0.1 mol/litter hydrochloric acid solution added in the blank test;

C: the amount (ml) of the aqueous 0.1 mol/litter hydrochloric acid solution added in the main test;

f: the factor of the aqueous 0.1 mol/litter hydrochloric acid solution; and

S: the mass (g) of the sample.

In order to develop minuter latent image dots faithfully for making image quality higher, the toner in the present invention may preferably have a weight average particle diameter of from 3 μm to 10 μm, and more preferably from 4 μm to 9 μm. If it has a weight average particle diameter of less than 3 μm, the fluidity and stirring properties required for powder may be lowered, making it difficult to charge individual toner particles uniformly. Also, as the particle diameter is smaller, the toner tends to be involved in charge-up, thus its developing performance is lowered. Besides, fog is liable to undesirably occur in a low-temperature and low-humidity environment.

If on the other hand it has a weight average particle diameter of more than 10 μm, although fog can be suppressed, it is difficult to make image quality higher as stated above, and also the toner laid-on level at line areas may become large, undesirably resulting in large toner consumption.

The weight average particle diameter and particle size distribution of the toner may be measured by various methods using Coulter Counter Model TA-II or Coulter Multisizer (manufactured by Coulter Electronics, Inc.). In the present invention, Coulter Multisizer (manufactured by Coulter Electronics, Inc.) is used. An interface (manufactured by Nikkaki Bios Co.) that outputs number distribution and volume distribution is connected to a personal computer. As an electrolytic solution, an aqueous 1% NaCl solution is prepared using first-grade sodium chloride. For example, ISOTON R-II (available from Coulter Scientific Japan Co.) may be used.

As a measuring method, 0.1 to 5 ml of a surface active agent, preferably alkylbenzene sulfonate, is added as a dispersant to 100 to 150 ml of the aqueous electrolytic solution, and further 2 to 20 mg of a sample to be measured is added. The electrolytic solution in which the sample has been suspended is subjected to dispersion process for about 1 minute to about 3 minutes in an ultrasonic dispersion machine. The number distribution is calculated by measuring the number of toner particles of 2 μm or more in particle diameter by means of Coulter Multisizer using an aperture of 100 μm. Then the number-based, length-average particle diameter determined from number distribution, i.e. number average particle diameter, and weight average particle diameter are determined. In Examples given later as well, they are measured in the same way.

The toner used in the present invention may preferably have an average circularity of 0.960 or more and 1.000 or less. Inasmuch as the toner has an average circularity of 0.960 or more and 1.000 or less, it has a spherical or nearly spherical particle shape and has a good fluidity, and hence, can readily uniformly triboelectrically charged to have uniform charge quantity distribution. Thus, fog can be further reduced. Also, the toner having a high average circularity can be formed into fine and uniform ears on the toner carrying member, and hence, is preferable because the toner consumption can be further reduced on account of a synergistic effect with the low residual magnetization. In addition, when the toner has a mode circularity of 0.99 or more in its circularity distribution, it means that most toner particles have shapes close to true spheres, which is preferable because the above effect is more remarkably brought about.

The average circularity referred to herein is used as a simple method for expressing the shape of particles quantitatively. In the present invention, the shape of particles is measured with a flow type particle image analyzer FPIA-1000, manufactured by Sysmex Corporation, and the circularity (Ci) of each particle measured on the group of particles having a circle-equivalent diameter of 3 μm or more is individually determined according to the following expression (6). In addition, as shown in the following expression (7), the value found by dividing the sum total of circularities of all particles measured by the number (m) of all particles is defined as the average circularity (C).

$$\text{Circularity } (Ci) = \frac{\text{Circumferential length of a circle with the same projected area as particle image}}{\text{Circumferential length of particle projected image}} \quad (6)$$

$$\text{Average circularity } (C) = \sum_{i=1}^{m} Ci/m \quad (7)$$

The mode circularity refers to a peak circularity at which the value of a frequency in circularity frequency distribution comes to be maximum when the circularities of 0.40 to 1.00 are divided into 61 ranges at intervals of 0.01 and each of the circularities of particles measured is allotted to each of the divided ranges in accordance with the corresponding circularity.

The measuring device "FPIA-1000" used in the present invention employs a calculation method in which, in calculating the circularity of each particle and thereafter calculating the average circularity and mode circularity, particles are divided into classes in which the circularities of 0.40 to 1.00 are divided into 61 ranges in accordance with the circularities found, and the average circularity and mode circularity are calculated using the center values and frequencies of the division points. However, between the values of the average circularity and mode circularity calculated by this calculation method and the values of the average circularity and mode circularity calculated according to the above calculation equation which directly uses the circularity of each particle, there is only a very small difference, which is at a level that is substantially negligible. Accordingly, in the present invention, such a calculation method in which the concept of the above calculation equation which directly uses the circularity of each particle is utilized and partly modified may be used for the reason for handling data, e.g., shortening the calculation time and simplify the operational equation for calculation. The measurement is performed in such a procedure as shown below.

In 10 ml of water in which about 0.1 mg of a surface-active agent such as alkylbenzene sulfonate is dissolved, about 5 mg of the magnetic toner is dispersed to prepare a dispersion. Then the dispersion is exposed to ultrasonic waves (20 kHz, 50 W) for 5 minutes to have a concentration of 5,000 to 20,000 particles/μl, where the measurement is made using the above analyzer to determine the average circularity and mode circularity of the group of particles having a circle-equivalent diameter of 3 μm or more.

The average circularity referred to in the present invention is an index showing the degree of surface unevenness of magnetic toner particles. When the particles are perfectly spherical, it is indicated as 1.000. The more complicate the surface shape of magnetic toner particles, the smaller the value of average circularity is.

In this measurement, the reason why the circularity is measured only on the group of particles having a circle-equivalent diameter of 3 μm or larger, is that particles of external additives existing independently of toner particles are included in a large number in the group of particles having a circle-equivalent diameter smaller than 3 μm, which may affect the measurement not to enable the circularity of the group of toner particles to be accurately estimated.

The magnetic toner used in the present invention may preferably be mixed with a charge control agent in order to improve charging performance. As the charge control agent, any known charge control agents may be used. In particular, charge control agents are preferred which enables the toner to be quickly charged and also can stably maintain a constant charge quantity. In addition, where the toner particles are directly produced by polymerization, it is particularly preferable to use charge control agents weak in polymerization inhibitory action and free of any matter soluble in an aqueous dispersion medium. As specific compounds, the following may be cited: as negative charge control agents, metal compounds of aromatic carboxylic acids such as salicylic acid, alkylsalicylic acids, dialkylsalicylic acids, naphthoic acid and dicarboxylic acids; metal salts or metal complexes of azo dyes or azo pigments; polymers having a sulfonic acid or carboxylic acid group in their side chains; as well as boron compounds, urea compounds, silicon compounds, and carixarene. As positive charge control agents, the following may cited: quaternary ammonium salts, polymers having such a quaternary ammonium salt in their side chains, guanidine compounds, Nigrosine compounds and imidazole compounds.

Of these, it is more preferable from the viewpoint of performing uniform charging, to use a polymer having a sulfonic acid group.

In addition, it is more preferable that the ratio of a presence level (A) of the carbon element present at toner particle surfaces to a presence level (E) of the sulfur element present at the same surfaces, E/A, as measured by X-ray photoelectric spectrophotometry of the toner is $3\times10^{-4} \leqq E/A \leqq 50\times10^{-4}$.

Where the polymer having a sulfonic acid group is used in the suspension polymerization process, which can favorably produce the toner in the present invention, the polymer having a sulfonic acid group comes to be localized at the toner particle surfaces on account of its hydrophilicity and polarity. Hence, the value of E/A is controlled as shown above. This enables the toner to be quickly charged, and also have a sufficient charge quantity. Also, in virtue of an effect brought cooperatively by the magnetic properties of the magnetic powder and the uniform dispersion thereof, uniform charging performance can be achieved with ease, the spots around line images can vastly be remedied, and also the fog can not easily occur even in long-term service.

On the other hand, a toner in which the value of E/A is lower than $3\times10^{-4}$ is undesirable because it tends to be short in charge quantity. A toner in which the value of E/A is higher than $50\times10^{-4}$ can sufficiently quickly be charged, but is undesirable because the toner has excessively high charge quantity so as to tend to cause what is called charge-up and is broad in charge quantity distribution.

In addition, in the present invention, the ratio of the content (A) of the carbon element to the content (B) of the iron element which are present at toner particle surfaces, B/A, and the ratio of the content (A) of the carbon element to the content (E) of the sulfur element which are present at toner particle surfaces, E/A, are measured by analyzing the surface composition by ESCA (X-ray photoelectric spectrophotometry).

In the present invention, the instrument and measuring conditions of the ESCA are as follows:

Instrument used: 1600S type X-ray photoelectric spectrometer, manufactured by PHI Inc. (Physical Electronic Industries, Inc.).

Measuring conditions:

X-ray source, MgKa (400 W).

Spectral range, 800 μmΦ.

In the present invention, the surface atom concentration (atomic %) is calculated from the peak intensity of each element measured, using relative sensitivity factors provided by PHI Inc.

The toner is used as a measuring sample. Where external additives are added to the toner, toner particles are washed with a solvent not capable of dissolving the toner particles, such as isopropanol, to remove the external additives, and thereafter the measurement is made.

As a monomer used for producing the polymer having a sulfonic acid group, the following may be cited: Styrene sulfonic acid, 2-acrylamido-2-methylpropanesulfonic acid, 2-methacrylamido-2-methylpropanesulfonic acid, vinylsulfonic acid and methacrylsulfonic acid. The polymer having a sulfonic acid group as used in the present invention may be a homopolymer of any of the above monomers, or may be a copolymer of any of the above monomers with other monomer.

However, in particular, it may be a copolymer of a sulfonic acid group-containing (meth)acrylic amide type monomer and styrene and/or styrene-(meth)acrylic acid. This is preferable because the toner can have very good charging performance. In this case, the sulfonic acid group-containing (meth)acrylic amide type monomer may preferably be in a content of from 1.0 to 10.0 parts by mass based on 100 parts by mass of the copolymer. It may be added in such an amount as bringing the value of E/A into the range of from $3\times10^{-4}$ to $50\times10^{-4}$.

The monomer which forms the copolymer with the monomer having a sulfonic acid group includes vinyl type polymerizable monomers. Monofunctional polymerizable monomers and polyfunctional polymerizable monomers may be used.

The monofunctional polymerizable monomers may include the following: Styrene; styrene derivatives such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene and p-phenylstyrene; acrylate type polymerizable monomers such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate and 2-benzoyloxyethyl acrylate; methacrylate type polymerizable monomers such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate and dibutyl phosphate ethyl methacrylate; methylene aliphatic monocarboxylates; vinyl esters such as vinyl acetate, vinyl propionate, vinyl butyrate, vinyl benzoate and vinyl formate; vinyl ethers such as methyl vinyl ether, ethyl vinyl ether and isobutyl vinyl ether; and vinyl ketones such as methyl vinyl ketone, hexyl vinyl ketone and isopropyl vinyl ketone.

The polyfunctional polymerizable monomers may include the following: Diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis[4-(acryloxy-diethoxy)phenyl]propane, trimethyrolpropane triacrylate, tetramethyrolmethane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis[4-(methacryloxy-diethoxy)phenyl]propane, 2,2'-bis[4-(methacryloxy-polyethoxy)phenyl]propane, trimethyrolpropane trimethacrylate, tetramethyrolmethane tetramethacrylate, divinyl benzene, divinyl naphthalene, and divinyl ether.

The polymer having a sulfonic acid group may be produced by a process including bulk polymerization, solution polymerization, emulsion polymerization, suspension polymerization and ionic polymerization. In view of operability and so forth, solution polymerization is preferred.

The polymer having a sulfonic acid group has the following structure.

$$X\ (SO^{3-})n\cdot mY^{k+}$$

wherein X represents a polymer moiety derived from the above polymerizable monomer, $Y^+$ represents a counter ion, k is the valence number of the counter ion, and m and n are each an integer, n=k×m.

The counter ion may preferably be a hydrogen ion, a sodium ion, a potassium ion, a calcium ion or an ammonium ion, and more preferably a hydrogen ion.

The polymer having a sulfonic acid group may preferably have a weight average molecular weight (Mw) of from 2,000 to 100,000. If it has a weight average molecular weight (Mw) of less than 2,000, the toner may have poor fluidity, resulting in low transfer performance. If it has a weight average molecular weight (Mw) of more than 100,000, it takes time to dissolve in a monomer, and besides, it is difficult for the sulfur element to be uniformly present on the toner particle surfaces.

The polymer having a sulfonic acid group may preferably have a glass transition temperature (Tg) of from 50° C. to 100° C. If it has a glass transition temperature of less than 50° C., the toner may have poor fluidity and storage stability and deteriorate during long-term service. If on the other hand the toner has a glass transition temperature of more than 100° C., the toner may undesirably have poor fixing performance.

As methods for allowing toner particles to contain the charge control agent as above, it is common to use a method of internally adding it to the toner particles and, in the case where suspension polymerization is carried out, a method in which the charge control agent is added to a polymerizable monomer composition before granulation. A polymerizable monomer in which the charge control agent has been dissolved or suspended may be added in the midst of forming oil droplets in water to effect polymerization, or after the polymerization, to carry out seed polymerization so as to cover toner particle surfaces uniformly. Where an organometallic compound is used as the charge control agent, the compound may be added to the toner particles, and mixed and agitated under the application of shear to incorporate the charge control agent into toner particles.

The quantity of this charge control agent used depends on the type of the binder resin, the presence of any other additives, and the manner in which the toner is produced, inclusive of the manner of dispersion, and can not absolutely be specified. When added internally, the charge control agent may preferably be used in an amount ranging from 0.1 to 10 parts by mass, and more preferably from 0.1 to 5 parts by mass, based on 100 parts by mass of the binder resin. When added externally, it may preferably be added in an amount of from 0.005 to 1.0 part by mass, and more preferably from 0.01 to 0.3 parts by mass, based on 100 parts by mass of the toner.

The magnetic toner used in the present invention may preferably contain a release agent in order to improve fixing performance. In that case, the release agent may preferably be contained in an amount of from 1 to 30% by mass, and more preferably from 3 to 25% by mass, based on the binder resin. If the release agent is in a content of less than 1% by mass, the effect to be brought about by adding the release agent may be insufficient and also the effect of suppressing offset may be insufficient. If on the other hand it is in a content of more than 30% by mass, the toner may have poor long-term storage stability, and also toner materials such as the release agent and the magnetic powder may have poor dispersibility to cause a lowering of fluidity of the magnetic toner and a lowering of image characteristics. Besides, release agent components may ooze out, resulting in a lowering of running performance in a high-temperature and high-humidity environment. Furthermore, since the release agent (wax) is enclosed in a large quantity, the shape of toner particles tends to become distorted.

In general, toner images transferred onto a recording medium are thereafter fixed onto the recording medium by the aid of energy such as heat and pressure, thus semipermanent images are obtained. Heat-roll fixing is commonly in wide use. As stated previously, very high definition images can be obtained as long as a toner having a weight average particle diameter of 10 μm or less is used. However, toner particles having such a small particle diameter may enter the gaps between paper fibers when a recording medium such as paper is used, so that heat cannot sufficiently be taken in from a heat-fixing roller to tend to bring about low-temperature offset. However, in the toner according to the present invention, the release agent is incorporated in an appropriate quantity, whereby both high image quality and fixing performance can simultaneously be achieved.

The release agent usable in the toner according to the present invention may include the following: Petroleum waxes and derivatives thereof, such as paraffin wax, microcrystalline wax and petrolatum; montan wax and derivatives thereof; hydrocarbon waxes obtained by Fischer-Tropsch synthesis, and derivatives thereof; polyolefin waxes typified by polyethylene wax, and derivatives thereof; and naturally occurring waxes such as carnauba wax and candelilla wax, and derivatives thereof; the derivatives including oxides, block copolymers with vinyl monomers, and graft modified products; and higher aliphatic alcohols, fatty acids such as stearic acid and palmitic acid, or compounds thereof, acid amide waxes, ester waxes, ketones, hardened caster oil and derivatives thereof, vegetable waxes, and animal waxes.

The peak top temperatures of endothermic peaks of such release agents are measured according to "ASTM D 3417-99".

The magnetic toner used in the present invention may be produced by the following method. First, when it is produced by a pulverization process, for example, components necessary for the magnetic toner, such as the binder resin, the magnetic powder, the release agent, the charge control agent and optionally the colorant are thoroughly mixed by mean of a mixer such as a Henschel mixer or a ball mill. Thereafter, the mixture obtained is melt-kneaded by means of a heat kneading machine such as a heat roll, a kneader or an extruder to melt resins one another, and then, other magnetic toner materials such as the magnetic powder are dissolved or dispersed in the resins. The resultant kneaded product is cooled to solidify, followed by pulverization, classification and optionally surface treatment to obtain toner particles. The classification may be carried out before or after the surface treatment. In the step of classification, a multi-division classifier may preferably be used in view of production efficiency.

The pulverization step may be carried out by any method using a known pulverizer of a mechanical impact type, a jet type or the like. In order to obtain the toner having the preferable average circularity (0.960 or more) in the present invention, it is preferable to further apply heat to effect pulverization or to subsidiarily add mechanical impact. Also, it is possible to use, e.g., a hot-water bath method in which toner particles finely pulverized (and optionally classified) are dispersed in hot water, and a method in which the toner particles are passed through hot-air streams.

As means for applying mechanical impact force, it is possible to use, e.g., a method using a mechanical impact type pulverizer such as Kryptron system, manufactured by Kawasaki Heavy Industries, Ltd., or Turbo mill, manufactured by Turbo Kogyo Co., Ltd., and a method in which toner particles are pressed against the inner wall of a casing by centrifugal force by means of a high-speed rotating blade so that mechanical impact is imparted to the toner particles by force such as compression force or frictional force, as exemplified by apparatus such as Mechanofusion system, manufactured by Hosokawa Micron Corporation, or Hybridization system, manufactured by Nara Machinery Co., Ltd.

When such a mechanical impact method is used, thermomechanical impact in which heat is applied at a temperature around glass transition temperature Tg of the toner (Tg±10° C.) as treatment temperature is preferred from the viewpoint of prevention of agglomeration and productivity. More preferably, heat may be applied at a temperature within ±5° C. of the glass transition temperature Tg of the toner, as being especially effective in improving transfer efficiency.

As the binder resin used when the toner according to the present invention is produced by the pulverization process, the following may be cited: Homopolymers of styrene or derivatives thereof, such as polystyrene and polyvinyltoluene; styrene copolymers such as a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-dimethylaminoethyl acrylate copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer, a styrene-maleic acid copolymer and a styrene-maleate copolymer; and polymethyl methacrylate, polybutyl methacrylate, polyvinyl acetate, polyethylene, polypropylene, polyvinyl butyral, silicone resins, polyester resins, polyamide resins, epoxy resins and polyacrylic acid resins. Any of these binder resins may be used alone or in a combination of two or more types. Of these, styrene copolymers and polyester resins are particularly preferred in view of developing performance, fixing performance and so forth.

The toner may preferably have a glass transition temperature (Tg) of from 30° C. to 80° C., and more preferably from 35° C. to 70° C. If it has Tg lower than 30° C., the toner may have low storage stability. If it has Tg higher than 80° C., it may have poor fixing performance. The glass transition temperature of the toner may be measured with, e.g., a differential scanning calorimeter. The measurement is made according to ASTM D 3418-99. In the measurement, the temperature of a sample is raised once to remove the history and thereafter rapidly cooled. The temperature is again raised at a heating rate of 10° C./min within a temperature range of from 30° C. to 200° C., and the DSC curve measured during the course of heating is used.

The magnetic toner in the present invention may be produced by the pulverization process as described previously. However, the toner particles obtained by such pulverization are commonly amorphous, and hence any mechanical and thermal or any special treatment must be carried out in order to attain such physical properties that the average circularity is 0.960 or more, which is preferably used in the present invention, resulting in inferior productivity. Accordingly, the toner in the present invention may preferably be obtained by producing toner particles in a wet process, as in dispersion polymerization, association agglomeration, suspension polymerization and solution polymerization. In particular, suspension polymerization may readily satisfy preferable physical properties required in the present invention, and is very preferred.

The suspension polymerization is a process in which the polymerizable monomer and the colorant (and further optionally a polymerization initiator, a cross-linking agent, the charge control agent and other additives) are uniformly dissolved or dispersed to make up a polymerizable monomer composition, and thereafter this polymerizable monomer composition is dispersed in a continuous phase (e.g., an aqueous phase) containing a dispersion stabilizer, by means of a suitable stirrer to simultaneously carry out polymerization to produce a toner having the desired particle diameters. In the toner obtained by this suspension polymerization (hereinafter simply referred to also as "polymerization toner"), the individual toner particles stand uniform in a substantially spherical shape, and hence the toner can satisfy the requirement for such physical properties that the average circularity is 0.960 or more, which is preferable in the present invention, and moreover can have a relatively uniform distribution of charge quantity, and hence can be expected to improve image quality.

A production process according to the suspension polymerization is described below. The suspension polymerization toner may commonly be produced in the following way: A toner composition, i.e., a polymerizable monomer composition prepared by adding appropriately to a polymerizable monomer(s) to be made into the binder resin, the magnetic powder, the release agent, a plasticizer, the charge control agent, a cross-linking agent, and optionally the colorant, which are components necessary for toners, and other additives as exemplified by a high polymer and a dispersant, followed by uniform dissolution or dispersion by means of a dispersion machine or the like, is suspended in an aqueous medium containing a dispersion stabilizer.

In the production of the polymerization toner according to the present invention, the polymerizable monomer contained in the polymerizable monomer composition may include the following: Styrene monomers such as styrene, o-methylstyrene, m-methylstyrene, p-methylstyrene, p-methoxystyrene and p-ethylstyrene; acrylic esters such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate and phenyl acrylate; methacrylic esters such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; and other monomers such as acrylonitrile, methacrylonitrile and acrylamides. Any of these monomers may be used alone or in the form of a mixture of two or more types. Of the foregoing monomers, styrene or a styrene derivative may preferably be used alone or in the form of a mixture with other monomer(s), in view of the developing performance and durability of the toner.

In the production of the polymerization toner according to the present invention, the polymerization may be carried out with the addition of a resin to the polymerizable monomer composition. For example, when it is desired to introduce into toner particles a polymerizable monomer component containing a hydrophilic functional group such as an amino group, a carboxylic acid group, a hydroxyl group, a sulfonic acid group, a glycidyl group or a nitrile group, which can not be used as a monomer because it is water-soluble and dissolves in an aqueous suspension to cause emulsion polymerization, it may be used in the form of a copolymer, such as a random copolymer, a block copolymer or a graft copolymer, with a vinyl compound such as styrene or ethylene, in the form of a product of polycondensation with polyester or polyamide, or in the form of a product of polyaddition with polyether or polyimine. Where the high polymer containing such a polar functional group is incorporated in the toner particles, it is localized at the toner particle surfaces, so that a toner having good anti-blocking properties and developing performance can be obtained.

Of these resins, a polyester resin is incorporated to exhibit a particularly great effect. This is presumed to be for the following reason. The polyester resin contains many ester linkages, which are functional groups having a relatively high polarity, and hence the resin itself has a high polarity. On account of the polarity, a strong tendency for the polyester to localize at the droplet surfaces is shown in the aqueous dispersion medium, and the polymerization proceeds in that state to produce toner particles. Hence, the polyester resin localizes at the toner particle surfaces to provide a uniform surface state and surface composition, so that the toner can have uniform charging performance, and because of a synergistic effect with the good enclosure of the release agent, can have very good developing performance.

As the polyester resin used in the present invention, a saturated polyester resin, an unsaturated polyester resin or the two may be appropriately selected and used in order to control the properties of the toner, such as charging performance, running performance and fixing performance.

In the present invention, any conventional polyester resins may be used which are constituted of an alcohol component and an acid component. They are as exemplified below.

As the alcohol component, the following may be cited: Ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, cyclohexane dimethanol, butenediol, octenediol, cyclohexene dimethanol, hydrogenated bisphenol A, glycerol, pentaerythritol, sorbitol, an oxyalkylene ether of novolak phenol resin, a bisphenol derivative represented by the following Formula (I)

(I)

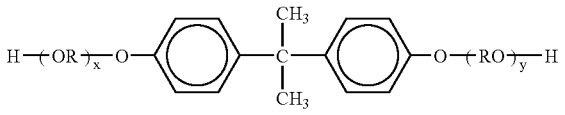

wherein R represents an ethylene group or a propylene group, x and y are each an integer of 1 or more, and an average value of x+y is 2 to 10;

or a hydrogenated product of the compound of the above Formula (I), and a diol represented by the following Formula (II):

(II)

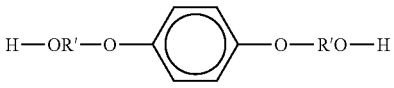

wherein R' represents —$CH_2CH_2$—, —$CH_2CH(CH_3)$—, or —$CH_2$—$C(CH_3)_2$—; or a hydrogenated product diol of the compound of the above Formula (II).

As the acid component, the following may be cited: Benzene dicarboxylic acids or anhydrides thereof, such as phthalic acid, terephthalic acid, isophthalic acid and phthalic anhydride; alkyldicarboxylic acids such as succinic acid, adipic acid, sebacic acid and azelaic acid, or anhydrides thereof, or succinic acid or its anhydride, substituted with a lower alkyl or alkenyl group having 6 to 18 carbon atoms; unsaturated dicarboxylic acids such as fumaric acid, maleic acid, citraconic acid and itaconic acid, or anhydrides thereof; and trimellitic acid, pyromellitic acid, 1,2,3,4-butanetetracarboxylic acid, benzophenonetetracarboxylic acid and anhydrides thereof.

Of the above polyester resins, an alkylene oxide addition product of the above bisphenol A is preferably used which has superior charge characteristics and environmental stability and in which other electrophotographic properties are balanced. In the case of this compound, the alkylene oxide may preferably have an average addition molar number of from 2 to 10 in view of the fixing performance and durability of the toner.

The polyester resin in the present invention may preferably be composed of 45 to 55 mol % of the alcohol component and 55 to 45 mol % of the acid component in the whole components.

The polyester resin may preferably have an acid value of from 0.1 to 50 mgKOH/1 g of resin, in order for the resin to be present at the toner particle surfaces of the magnetic toner in the present invention and for the resultant toner particles to exhibit a stable charging performance. If it has an acid value of less than 0.1 mgKOH/1 g of resin, it may be present at the toner particle surfaces in an absolutely insufficient quantity. If it has an acid value of more than 50 mgKOH/1 g of resin, it tends to adversely affect the charging performance of the toner. In the present invention, it may more preferably have the acid value in the range of from 5 to 35 mgKOH/1 g of resin.

In the present invention, as long as physical properties of the toner particles obtained are not adversely affected, it is also preferable to use two or more types of polyester resins in combination or to regulate physical properties of the polyester resin by modifying the polyester resin with, e.g., silicone or a fluoroalkyl group-containing compound.

In the case where the high polymer containing such a polar functional group is used, its number average molecular weight is preferably 3,000 or more. Such a high polymer as having an average molecular weight of less than 3,000 are not preferable because it is apt to concentrate in the vicinity of the surfaces of toner particles and tends to lower developing performance, anti-blocking properties and so forth. The high polymer may also have a ratio of a weight average particle diameter to a number average molecular weight, Mw/Mn, of from 1.2 to 10.0 from the viewpoint of fixing performance and anti-blocking properties. The number average molecular weight and the weight average particle diameter can be measured by GPC.

For the purpose of improving dispersibility of materials, fixing performance or image characteristics, a resin other than the foregoing may also be added to the monomer composition. The resin usable therefor may include, e.g., the following: Homopolymers of styrene or derivatives thereof, such as polystyrene and polyvinyltoluene; styrene copolymers such as a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-dimethylaminoethyl acrylate copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer, a styrene-maleic acid copolymer and a styrene-maleate copolymer; and polymethyl methacrylate, polybutyl methacrylate, polyvinyl acetate, polyethylene, polypropylene, polyvinyl butyral, silicone resins, polyester resins, polyamide resins, epoxy resins, polyacrylic acid resins, rosins, modified rosins, terpene resins, phenolic resins, aliphatic or alicyclic hydrocarbon resins, and aromatic petroleum resins. Any of these resins may be used alone or in the form of a mixture. Any of these resins may preferably be added in an amount of from 1 to 20 parts by mass based on 100 parts by mass of the polymerizable monomer. With the amount of less than 1 part by mass, the effect of the addition is not sufficiently exhibited. On the other hand, if added in an amount of more than 20 parts by mass, it is difficult to design the various physical properties of the polymerization toner.

As the polymerization initiator used in the production of the magnetic toner in the present invention, a polymerization initiator having a half-life of from 0.5 to 30 hours may be added at the time of polymerization reaction in an amount of from 0.5 to 20 parts by mass based on 100 parts by mass of the polymerizable monomer, to carry out polymerization, where a polymer having a maximum molecular weight in the region of molecular weight of from 10,000 to 100,000 is produced to endow the toner with desirable strength and appropriate melt properties.

The polymerization initiator may include the following: Azo type or diazo type polymerization initiators such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile and azobisisobutyronitrile; and peroxide type polymerization initiators such as benzoyl peroxide, methyl ethyl ketone peroxide, diisopropyl peroxycarbonate, cumene hydroperoxide, 2,4-dichlorobenzoyl peroxide, lauroyl peroxide, t-butyl peroxy-2-ethylhexanoate and t-butyl peroxypivarate.

When the magnetic toner in the present invention is produced, a cross-linking agent may be added. This cross-linking agent may preferably be added in an amount of from 0.001 to 15 parts by mass based on 100 parts by mass of the polymerizable monomer.

As the cross-linking agent, compounds having at least two polymerizable double bonds may be primarily used, including, e.g., the following: Aromatic divinyl compounds such as divinyl benzene and divinyl naphthalene; carboxylic acid esters having two double bonds, such as ethylene glycol diacrylate, ethylene glycol dimethacrylate and 1,3-butanediol dimethacrylate; divinyl compounds such as divinyl aniline, divinyl ether, divinyl sulfide and divinyl sulfone; and compounds having at least three vinyl groups. Any of these cross-linking agents may be used alone or may be used in the form of a mixture.

In the case of producing the magnetic toner in the present invention by polymerization, commonly a polymerizable monomer composition prepared by adding the above toner component materials and dissolving or dispersing them by means of a dispersion machine such as a homogenizer, a ball mill, a colloid mill or an ultrasonic dispersion machine, is suspended in an aqueous medium containing a dispersion stabilizer. In this case, a high-speed dispersion machine such as a high-speed stirrer or an ultrasonic dispersion machine may be used to allow the magnetic toner particles to have the desired particle size at a stretch, thereby rendering the particle size distribution of the resultant sharp. The polymerization initiator may be added simultaneously with other additives, or may be mixed immediately before other additives are suspended in the aqueous medium. Also, immediately after granulation, a polymerization initiator having been dissolved in the polymerizable monomer or solvent may be added before the polymerization reaction is initiated.

After granulation, agitation may be carried out using a usual agitator in such an extent that the state of particles is maintained and the particles can be prevented from floating or settling.

When the magnetic toner in the present invention is produced, any of known surface-active agents or organic or inorganic dispersants may be used as a dispersion stabilizer. In particular, the inorganic dispersants may hardly cause any harmful ultrafine powder and attain dispersion stability on account of their steric hindrances. Hence, even when reaction temperature is changed, they can maintain the stability, can be washed with ease and hardly adversely affect toners, and thus can preferably be used. As examples of such inorganic dispersants, the following may be cited: Phosphoric acid polyvalent metal salts such as tricalcium phosphate, magnesium phosphate, aluminum phosphate, zinc phosphate and hydroxylapatite; carbonates such as calcium carbonate and magnesium carbonate; inorganic salts such as calcium metasilicate, calcium sulfate and barium sulfate; and calcium hydroxide, magnesium hydroxide and aluminum hydroxide.

Any of these inorganic dispersants may preferably be used in an amount of from 0.2 to 20 parts by mass based on 100 parts by mass of the polymerizable monomer. The above dispersion stabilizers may be used alone or in combination of two or more types. A surface-active agent may further be used in combination in an amount of from 0.001 to 0.1 part by mass based on 100 parts by mass of the polymerizable monomer.

When these inorganic dispersants are used, they may be used as they are. In order to obtain finer particles, particles of the inorganic dispersant may be formed in the aqueous medium. For example, in the case of tricalcium phosphate, an aqueous medium phosphate solution and an aqueous calcium chloride solution may be mixed under high-speed agitation, whereby water-insoluble calcium phosphate can be formed and more uniform and finer dispersion can be achieved. In this case, water-soluble sodium chloride is simultaneously formed as a by-product. However, the presence of such a water-soluble salt in the aqueous medium keeps the polymerizable monomer from being dissolved in water, and ultrafine toner particles is difficult to produce by emulsion polymerization, which is advantageous.

Such a surface-active agent may include the following: Sodium dodecylbenzenesulfate, sodium tetradecyl sulfate, sodium pentadecyl sulfate, sodium octyl sulfate, sodium oleate, sodium laurate, sodium stearate and potassium stearate.

In the present invention, it is preferable that at least one element selected from magnesium, calcium, barium and aluminum is present on the toner particle surfaces in a level of from 5 to 1,000 ppm, and more preferably from 10 to 500 ppm. This brings about a more improvement in the uniformity of charging, and is effective in reducing fog and spots around line images. The reason therefor is unclear, but, according to the present inventors, is considered to be that electric charges are exchanged between the above divalent or trivalent element such as magnesium, calcium, barium or aluminum and a magnetic material having a specific element, thereby bringing about the same effect as exhibited by a charging auxiliary.

However, if any of these elements is in a level of less than 5 ppm, the above effect is difficult to bring about, and, if present in a level of more than 1,000 ppm, the toner may have a low charge quantity especially in a high-temperature and high-humidity environment to greatly cause fog.

Where a plurality of elements among the magnesium, calcium, barium and aluminum are present on the toner particle surfaces, they may preferably be in a level of from 5 to 1,000 ppm in total.

Among such elements, magnesium and calcium are preferred because they are effective especially in keeping the charge-up from occurring.

Such elements may preferably be present on the toner particle surfaces, and their levels may be controlled by a method in which compounds containing the elements are externally added, or by the manner and conditions for washing the dispersant described previously.

In the present invention, the magnesium, calcium, barium and aluminum present on the toner particle surfaces are meant to be elements present on the particle surfaces in the state that external additives have been removed by putting the toner in a solvent not capable of dissolving the toner, such as isopropanol, and applying vibrations for 10 minutes by means of an ultrasonic cleaner.

The presence levels of these elements may quantitatively be determined by a known analytical method such as fluorescent X-ray analysis or plasma emission spectrometry (ICP spectroscopy) applied to the toner particles from which the external additives have been removed.

In Examples described later, the measurement of each element is made by fluorescent X-ray analysis, whose details accord with JIS K 0119.

(1) Regarding Instrument Used:

Fluorescent X-ray analyzer 3080 (manufactured by Rigaku Corporation).

Sample press molding machine MAEKAWA Testing Machine (manufactured by MFG Co., Ltd.).

(2) Regarding Preparation of Calibration Curve:

A composite compound to be subjected to quantitative determination is externally added at the level of 5 using a coffee mill to prepare a sample. This sample is press-molded by means of the sample press molding machine. The [M]Kα peak angle (a) in the composite compound is determined from the 2θ table. Calibration samples are put into the fluorescent X-ray analyzer, and the sample chamber is evacuated to a vacuum. The X-ray intensity of each sample is determined under the following conditions to prepare a calibration curve (weight ratio: expressed by ppm).

(3) Regarding Measuring Conditions:

Measuring potential, voltage: 50 kV, 50 to 70 mA.

2θ Angle: a.

Crystal plate: LiF.

Measuring time: 60 seconds.

(4) Regarding Quantitative Determination of the Above Elements in Toner Particles:

A sample is molded in the same manner as in the calibration curve. Thereafter, the X-ray intensity is determined under the same measuring conditions, and the content is calculated from the calibration curve.

Where the compound having the magnesium, calcium, barium and aluminum elements are not present except for the toner particle surfaces, the presence level of each element is determined by the above method. Where, however, any of these elements is present except for the toner particle surfaces, the presence level of each element is determined in the following way.

First, the presence level of each element is determined by the above method, which is defined as presence level A.

Next, toner particles from which external additives have been removed are agitated in concentrated nitric acid for 1 hour, and then sufficiently washed with pure water, followed by drying, and the presence level of each element is determined by the above method, which is defined as presence level B.

The presence level of each element on the toner particle surfaces may be found from the difference between A and B, i.e., the value of A−B.

Even where the above elements are contained in magnetite or the like, the magnetite is passivated with the concentrated nitric acid, and is not dissolved. Hence, it is possible to measure the presence levels of only the elements on the toner particle surfaces.

In the step of polymerization described previously, the polymerization may be carried out at a polymerization temperature set at 40° C. or more, and commonly at a temperature of from 50° C. to 90° C. Where the polymerization is carried out in this temperature range, the release agent or wax to be enclosed in particles becomes deposited by phase separation and more perfectly enclosed in particles. In order to consume residual polymerizable monomers, the reaction temperature may be raised to 90° C. to 150° C. at the termination of polymerization reaction.

In the magnetic toner in the present invention, it is preferable that after the polymerization is completed, the polymerization toner particles are separated by filtration, washed and dried by known methods, and an inorganic fine powder is optionally mixed so as to be deposited on the particle surfaces. Also, the step of classification may be added to the production process to remove coarse powder and fine powder.

In the present invention, an embodiment is preferred in which the magnetic toner has an inorganic fine powder added as a fluidity improver, having a number average primary particle diameter of from 4 nm to 80 nm, and more preferably from 6 nm to 40 nm. While the inorganic fine powder is added primarily in order to improve the fluidity of the toner and to uniformly charge the toner particles, an embodiment is also preferred in which the inorganic fine powder is subjected to, e.g., hydrophobic treatment to be endowed with a function to regulate the charge quantity of toner and to improve the environmental stability of toner.

If the inorganic fine powder having a number average primary particle diameter of 80 nm or less is not added, good fluidity of the toner is not achieved, so that the toner particles tend to be non-uniformly charged to inevitably cause problems such as an increase in fog, a decrease in image density and an increase in toner consumption. If on the other hand the inorganic fine powder has a number average primary particle diameter of less than 4 nm, the inorganic fine powder is liable to agglomerate, and tends to behave not as primary particles but as agglomerates having broad particle size distribution which are difficult to break up even by disintegration processing and are strongly agglomerative, so that the agglomerates may be involved in development or may scratch the image bearing member, the magnetic toner carrying member and so forth, undesirably resulting in image defects.

In the present invention, the number average primary particle diameter of the inorganic fine powder may be measured in the following way. On a photograph of toner particles, taken under magnification with a scanning electron microscope and in comparison with a photograph of toner particles mapped with elements contained in the inorganic fine powder by an elemental analysis means such as XMA (X-ray microanalyzer) attached to the scanning electron microscope, at least 100 primary particles of the inorganic fine powder which adhere to, or are liberated from, the toner particle surfaces are measured to determine the number average primary particle diameter.

As the inorganic fine powder used in the present invention, fine silica powder, fine titanium oxide powder, fine alumina powder or the like may be cited.

As the fine silica powder, it is possible to use, e.g., fine alumina powder which is what is called dry-process silica or fumed silica produced by vapor phase oxidation of silicon halides and what is called wet-process silica produced from water glass or the like. The dry-process silica is preferred, as having fewer silanol groups on the particle surfaces and particle interiors of the fine silica powder and leaving fewer production residues such as $Na_2O$ and $SO_3^{2-}$. In the dry-process silica, it is also possible to use, e.g., in its production step, other metal halide such as aluminum chloride or titanium chloride together with the silicon halide to give a composite fine powder of silica with other metal oxides.

The inorganic fine powder having a number average primary particle diameter of from 4 nm to 80 nm may preferably be added in an amount of from 0.1 to 3.0% by mass based on the mass of the toner particles. If it is added in an amount of less than 0.1% by mass, its effect may be insufficiently exhibited. If it is added in an amount of more than 3.0% by mass, the toner may have poor fixing performance.

The content of the inorganic fine powder may be determined using fluorescent X-ray analysis and using a calibration curve prepared from a standard sample.

In the present invention, the inorganic fine powder may preferably be a powder having been subjected to hydrophobic treatment. This is preferable because the toner can be improved in environmental stability. Where the inorganic fine powder added to the toner is moistened, the toner particles may be charged in a very low quantity to tend to have non-uniform charge quantity and to cause toner scatter.

As a treating agent used for such hydrophobic treatment, the following may be cited: such as silicone varnishes, modified silicone varnishes of various types, silicone oils, modified silicone oils of various types, silane compounds, silane coupling agents, other organic silicon compounds and organotitanium compounds. Any of these treating agents may be used alone or in a combination of two or more types.

In particular, those having been treated with a silicone oil are preferred. Those obtained by subjecting the inorganic fine powder to hydrophobic treatment with a silane compound and, simultaneously with or after the treatment, treatment with a silicone oil are more preferred in order to maintain the charge quantity of the toner particles at a high level even in a high humidity environment and to prevent toner scatter.

As a method for such treatment of the inorganic fine powder, for example the inorganic fine powder may be treated, as first-stage reaction, with the silane compound to effect silylation reaction to cause silanol groups to disappear by chemical coupling, and thereafter, as second-stage reaction, with the silicone oil to form hydrophobic thin films on particle surfaces.

The silicone oil may preferably be one having a viscosity of from 10 to 200,000 $mm^2/s$ at 25° C., and more preferably from 3,000 to 80,000 $mm^2/s$. If its viscosity is less than 10 $mm^2/s$, the inorganic fine powder may have no stability, and the image quality tends to lower because of thermal and mechanical stress. If its viscosity is more than 200,000 $mm^2/s$, it tends to be difficult to perform uniform treatment.

As the silicone oil to be used, the following may be cited: for example, Dimethylsilicone oil, methylphenylsilicone oil, α-methylstyrene modified silicone oil, chlorophenylsilicone oil and fluorine modified silicone oil.

As a method for treating the inorganic fine powder with the silicone oil, for example, a method may be sued in which the inorganic fine powder having been treated with a silane compound and the silicone oil may directly be mixed by means of a mixer such as a Henschel mixer, or a method may be used in which the silicone oil is sprayed on the inorganic fine powder. Alternatively, a method may be used in which the silicone oil is dissolved or dispersed in a suitable solvent and thereafter the inorganic fine powder is added and mixed, followed by removing the solvent. In view of such an advantage that agglomerates of the inorganic fine powder are relatively reduced, the method using a sprayer is preferred.

The silicone oil may be used for the treatment in an amount of from 1 to 40 parts by mass, and preferably from 3 to 35 parts by mass, based on 100 parts by mass of the inorganic fine powder. If the amount of the silicone oil is too small, the inorganic fine powder can not be made well hydrophobic. If it is in too large quantity, difficulties such as fogging tend to occur.

In order to endow the toner with good fluidity, the inorganic fine powder used in the present invention may preferably be one having a specific surface area ranging from 20 to 350 $m^2/g$, and more preferably from 25 to 300 $m^2/g$, as measured by the BET method utilizing nitrogen adsorption.

The specific surface area is measured according to the BET method, where a specific surface area measuring instrument AUTOSOBE 1 (manufactured by Yuasa Ionics Co.) is used, nitrogen gas is adsorbed on the sample surfaces, and the specific surface area is calculated by the BET multiple point method.

In order to improve cleaning performance and so forth, inorganic or organic nearly spherical fine particles having a primary particle diameter of more than 30 nm (preferably having a BET specific surface area of less than 50 $m^2/g$), and more preferably a primary particle diameter of more than 50 nm (preferably having a BET specific surface area of less than 30 $m^2/g$), may further be added to the magnetic toner in the present invention. This is also one of preferred embodiments. For example, spherical silica particles, spherical polymethyl silsesquioxane particles and spherical resin particles may preferably be used.

In the magnetic toner used in the present invention, other additives may further be added. Such additives may include, e.g., the following: Lubricant powders such as polyethylene fluoride powder, zinc stearate powder and polyvinylidene fluoride powder; abrasives such as cerium oxide powder, silicon carbide powder and strontium titanate powder; anti-caking agents; and developability improvers such as reverse-polarity organic particles and inorganic particle. These additives may also be used after hydrophobic treatment of their particle surfaces.

The developer carrying member used in the present invention is described next.

The developer carrying member in the present invention is characterized in that it has at least a substrate and a conductive resin coat layer on the surface of the substrate, and the conductive resin coat layer satisfies, in its surface profile measured using a focus optics laser, $1.00 \leqq S/A \leqq 1.65$ and preferably $1.08 \leqq S/A \leqq 1.60$ where the area of microscopic unevenness regions from which parts exceeding a reference plane by 0.5×r (r: weight average particle diameter μm of a toner used) or more have been removed is represented by A ($m^2$) and the surface area of the microscopic unevenness regions is represented by S ($m^2$).

In the developer carrying member in the present invention, the surface profile of regions from which parts on the developer carrying member surface having large irregularities (i.e. parts exceeding a reference plane by 0.5×r (r: weight average particle diameter μm of a toner used) or more) have been removed, which primarily contribute to transport performance, is taken into account. That the microscopic unevenness regions are controlled within the range of $1.00 \leqq S/A \leqq 1.65$ means that the microscopic unevenness profile of the conductive resin coat layer surface is smooth and uniform. For example, if a surface having a profile with a larger degree of microscopic unevenness is formed, the surface unevenness correspondingly becomes more non-uniform, so that the toner tends to be locally non-uniformly charged and to have non-uniform charge distribution. As a result, the toner has a tendency to have a broad charge distribution, and toner triboelectrically charged in excess or toner triboelectrically charged insufficiently may relatively increase to create ghosts and fog greatly. As in the present invention, where the developer carrying member surface is smooth and uniform, it is easy for individual toner particles to microscopically uniformly have charges, i.e., the toner can be rapidly and uniformly charged in an appropriate charge quantity. In addition, inasmuch as the developer carrying member surface has a uniform profile, the toner coat level on the developer carrying member can be kept from becoming locally non-uniform, so that ears of the toner can readily uniformly be formed. Hence, this enables image defects such as ghosts and fog to be kept from occurring. Especially when used in combination with the toner used in the present invention, i.e., the toner using the magnetic powder having a high saturation magnetization and a low residual magnetization, the effect of, e.g., reducing toner consumption and keeping spots around line images and fog from occurring can more remarkably be brought out.

Where the toner having a high circularity as in the present invention is used, the toner tends to have a large triboelectric charge quantity and the toner coat level on the sleeve may become too high. Concurrently therewith, the phenomena such as sleeve ghosts and blotches tend to come about. For example, as countermeasures thereagainst, in the case of a developing system using what is called an elastic blade, in which an elastic member made of urethane rubber or the like is used as a layer thickness control member, it is effective to make control power higher, e.g., to increase blade pressure. In such a case, however, the stress applied to the toner and developer carrying member also increases. The present inventors have discovered that the developer carrying member may be set up as described above, whereby, even when the blade pressure is set to be higher, the roughness of the surface coat layer of the developer carrying member, the uniformity of the surface profile and a change in material composition of the surface can be controlled over long-term service, and, especially when the toner as described above is used, the toner can be of low consumption, and high-grade images free of spots around line images and fog can continuously be provided.

The unevenness profile of the developer carrying member surface is measured with an ultradepth profile measuring microscope VK-8500 (manufactured by Keyence Corporation). This instrument is to measure the profile of an object according to objective lens positional information obtained when laser beams emitted from a light source are applied to the object and the reflected light reception level of the laser beams reflecting from the object in a photo acceptance unit located at the cofocal position comes to maximum.

Measuring conditions are set in the following way.

Objective lens magnification: 100 magnifications.

Optical zoom magnification: 1 magnification.

Digital zoom magnification: 1 magnification.

Run mode: Color ultradepth.

Lens movement pitch in the height direction: 0.1 μm.

Laser gain: 716.

Laser offset: −335.

Shutter (camera setting): 215.

The results of measurement are analyzed with an image analysis software VK-H1W (version 1.07; manufactured by Keyence Corporation). First, inclination correction processing is performed in order to correct the whole inclination of the results of measurement. The processing is performed only for height data, and the correction is performed in a plane correction automatic mode.

Next, in order to remove noise components resulting from the measurement, smoothing is performed by filter processing. Processing conditions therefor are shown below.

Processing object: Height data.

Processing size: Smoothing in the region of 3×3.

Execution time: Once.

Filter type: Simple average.

Figure 4:
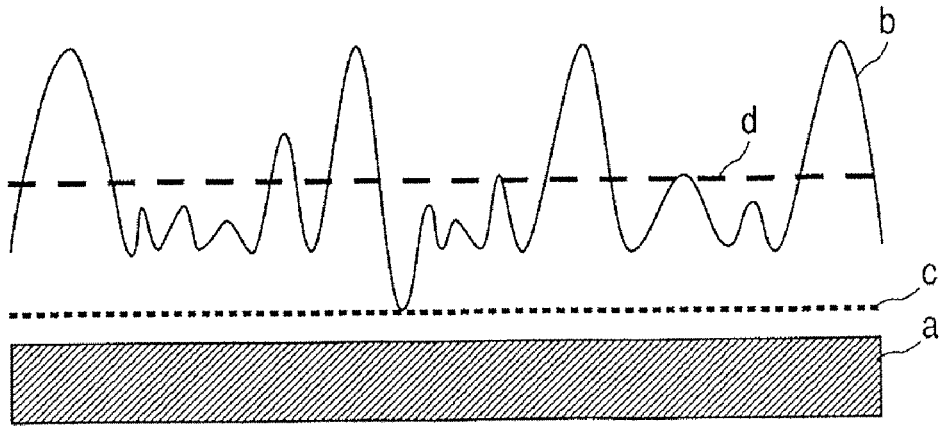
FIG. 4 is a view showing a reference plane specified when determining the value of S/A of the surface of the coat layer according to the present invention.

Next, the height data obtained by the measurement are converted into CSV text data. Thereafter, the average value of heights found when, as shown in FIG. 4, the lowest part c of the coat layer surface portion in the whole region (300 μm in lateral direction×220 μm in longitudinal direction) of measured areas is defined as a base is calculated. In the present invention, the position of the average value of the heights from the lowest part c of the coat layer surface portion in the measured region is defined as reference plane d. In FIG. 4, a letter symbol a represents the substrate; and b, the conductive resin coat layer.

Figure 5:
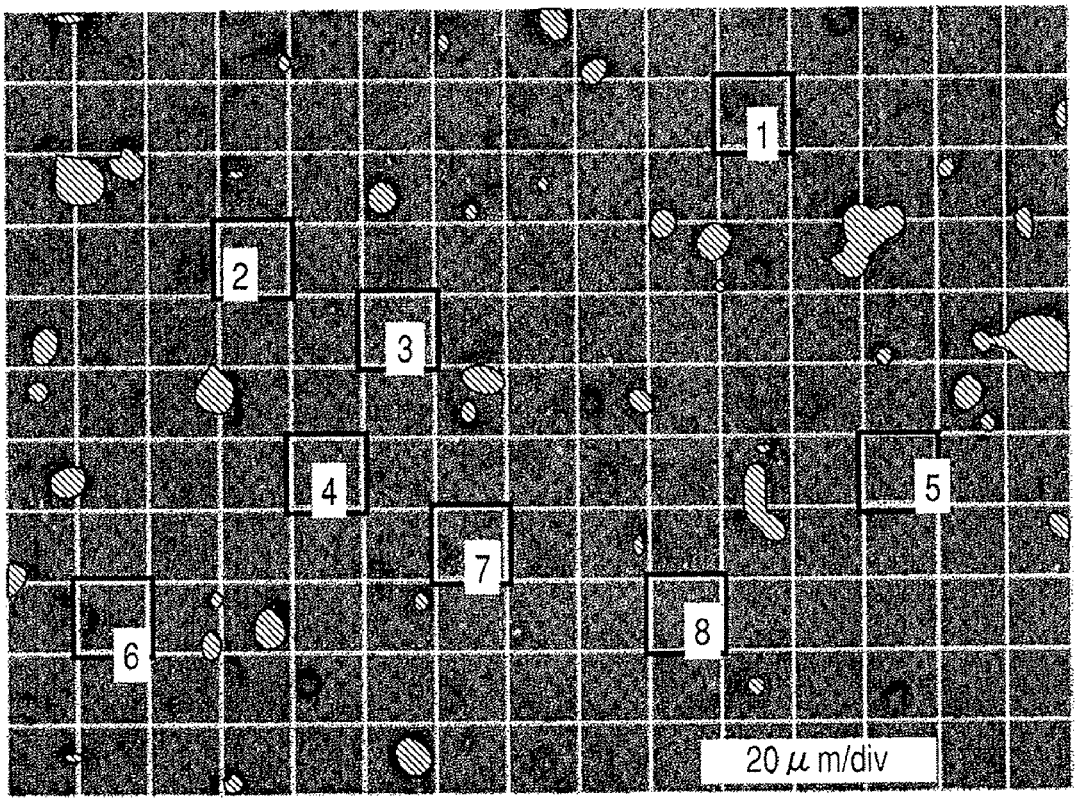
FIG. 5 is a view showing an example where the value of S/A of the surface of the coat layer according to the present invention is determined.

Further, using a surface area measuring mode in the image analysis software VK-H1W and regarding as upper-limit height the height of 0.5×r (r: weight average particle diameter μm of a toner used) from the reference plane d, the part that is more than the upper-limit height is excluded (as shown in FIG. 5, shaded portions means the parts to be excluded). In respect of the remaining part, regions each having an area A ($4.0\times10^{-10}$ $m^2$) of 20 μm in lateral direction×20 μm in longitudinal direction are appropriately so selected as not to extend to the parts to be extruded (the shaded portions) (e.g., regions 1, 2 to 8 surrounded by lines in FIG. 5 are selected), to calculate the surface area S ($m^2$) of microscopic unevenness regions observed in the area A ($m^2$) of microscopic unevenness regions. In Examples of the present invention, the values of S/A of microscopic unevenness regions at four places for each of five measured regions of the developer carrying member are found, and the average value of the values of S/A at the twenty places in total is calculated and defined as the value of S/A in the present invention.

If an uneven surface having a value of S/A more than 1.65 is formed, the conductive resin coat layer surface has a large degree of microscopic unevenness, and the profile of the unevenness becomes more non-uniform. Hence, the toner tends to be locally non-uniformly charged. As a result, the toner has a tendency to have broad charge distribution, and toner triboelectrically charged in excess or toner triboelectrically charged insufficiently may relatively increase to tend to cause ghosts and fog. This tends to occur especially when the elastic blade and the toner having a high sphericity are used in combination, and the toner contamination resulting from non-uniform unevenness is liable to occur to cause image non-uniformity and a decrease in image density in some cases.

In order to control the value of S/A within the range of from 1.00 to 1.65, it is preferable to regulate the dispersion state of particles present in the conductive resin coat layer, a coating method and so forth.

In order to control the value of S/A by the dispersion state of particles, it is preferable that the whole particles dispersed in the conductive resin coat layer have a volume average particle diameter of 3.0 μm or less. If they have a volume average particle diameter of more than 3.0 μm, the particles may provide the conductive resin coat layer with large unevenness so that the value of S/A is more than 1.65.

As a method of controlling the volume average particle diameter of such particles in the conductive resin coat layer, a means is available which regulates the particle size distribution of the particles to be used, using pulverization or classification. The particle size distribution of the particles may also be controlled by regulating dispersion strength in the step of dispersing the particles in a binder resin when a coating fluid for forming the conductive resin coat layer is prepared.

In the particles dispersed in the conductive resin coat layer in the present invention, it is preferable that the volume cumulative distribution (%) of particles of 10 μm or more in diameter are 3% or less, and more preferably 2% or less. If the volume cumulative distribution (%) of particles of 10 μm or more in diameter is more than 3%, non-uniform unevenness due to such particles tends to come about at the conductive resin coat layer surface so that the value of S/A is more than 1.65.

Where the value of S/A is controlled by a coating method, commonly the use of air spray coating enables the value of S/A to be so regulated as to be somewhat large and the use of dip coating enables the value of S/A to be so regulated as to be somewhat small, while differing in dependence upon the formulation and properties of the conductive resin coat layer to be used.

The particles to be added to the conductive resin coat layer in the developer carrying member in the present invention are described next.

In the present invention, in order to control the resistivity of the conductive resin coat layer, any of conductive particles as enumerated below may be incorporated in the coat layer. As conductive particles, the following may be cited: Particles of metals such as aluminum, copper, nickel and silver; particles of metal oxides such as antimony oxide, indium oxide and tin oxide; and carbon materials such as carbon fibers, carbon black and graphite particles. In the present invention, of these, the carbon black, in particular, amorphous carbon may preferably be used because it is particularly excellent in electric conductance, and can arbitrarily give a certain range of conductivity to a polymeric material only by its addition or only by controlling its amount to be added. It also has a fine particle diameter, and hence enables the smooth developer carrying member surface to be formed even when added in a large quantity for the purpose of imparting a high conductivity.

The carbon black used in the present invention may preferably have an average primary particle diameter of from 10 nm to 100 nm, and more preferably from 12 nm to 80 nm. As long as the carbon black has an average primary particle diameter of 10 nm or more, when preparing a coating material containing a binder resin and the carbon black used to form the resin coat layer, the carbon black can prevent the resultant coating material from having too high viscosity, because its particles are less agglomerative. Thus, the carbon black can be dispersed uniformly in the coating material. Also in the case where the carbon black has an average primary particle diameter of 100 nm or less, the carbon black can be dispersed uniformly in the coating material, hence a resin coat layer can easily be formed in which the carbon black has uniformly been dispersed. Thus, where carbon black having a superior lubricity is uniformly dispersed in the resin coat layer of the developer carrying member, the lubricity, conductivity and surface profile of the resin coat layer surface can be made uniform to bring about the effect of minimizing the toner charge-up and the effect of preventing the toner from melt-adhering to the developer carrying member surface and the developer layer thickness control member surface. In addition, the resin coat layer is prevented from wearing or coming off, and development bias is prevented from leaking, around large carbon black particles serving as nuclei. Such a conductive material preferable in the present invention may suitably be added in an amount ranging from 1 to 100 parts by mass based on 100 parts by mass of the binder resin.

As to fine particles of less than 1 μm in diameter of the carbon black and so forth, their particle diameters are measured with an electron microscope. The particles are photographed at 60,000 magnifications. If it is difficult to do so, the particles are photographed at a low magnification, and the photograph taken is printed at a magnification at which the particles are magnified 60,000-fold. Particle diameters of primary particles are measured on the photograph. In this case, a major axis (length) and a minor axis (breadth) of each particle are measured, and their average value is defined as particle diameter. The measurement is made on 100 samples, and their median diameter is defined as average particle diameter.

In the present invention, graphitized particles having a degree of graphitization p(002) of from 0.20 to 0.95 may also preferably be used as the conductive particles to be added to the conductive resin coat layer. The degree of graphitization p(002) is a value called Franklin's p-value, and is a value determined using the following expression (6) by measuring the lattice spacing d(002) obtained from an X-ray diffraction pattern of graphite.

$$d(002)=3.440-0.086\times(1-p(002)^2) \quad (6)$$

This p(002) value shows the proportion of disorderly portions among stacks of hexagonal network planes of carbon. The smaller the p(002) value, the higher the degree of graphitization is.

The above graphitized particles differ in raw materials and production steps from crystalline graphite particles composed of natural graphite, or artificial graphite obtained by hardening an aggregate such as coke with a tar pitch and molding the hardened matter, followed by calcining at approximately from 1,000° C. to 1,300° C. and then graphitization at approximately from 2,500° C. to 3,000° C. The graphitized particles used in the present invention have a little lower degree of graphitization than the crystalline graphite particles conventionally used, but have the same high conductivity and lubricity as the crystalline graphite particles. Besides, the graphitized particles used in the present invention have such characteristic features that they have a particle shape different from the scaly shape or acicular shape of the crystalline graphite particles and the hardness of particles themselves is relatively high.

The graphitized particles used in the present invention are added in order to provide the resin coat layer with properties such as uniform lubricity, conductivity, charge-providing performance and wear resistance by providing the resin coat layer surface with uniform and microscopic unevenness.

More specifically, where the graphitized particles having the properties as stated above are used in the resin coat layer, they may uniformly and finely be dispersed with ease in the coat layer, and the microscopic unevenness the graphitized particles form on the resin coat layer surface may readily be controlled in an appropriate size. Upon forming the microscopic unevenness on the resin coat layer surface, the contact area with the toner particle surfaces is adjusted to improve releasability of the toner, and at the same time, the contact area with the toner particle surfaces increases so that the toner can be easily uniformly charged, and the effect resulting from the superior charge characteristics and lubricity of the graphitized particles is further exhibited, and thus, the toner can be stably uniformly charged without causing any charge-up of toner, contamination by toner and melt adhesion of toner onto the resin coat layer surface.

The graphitized particles themselves used in the present invention are superior in lubricity, and have an appropriate hardness and hence have a small difference in hardness from the resin. Accordingly, the resin coat layer surface stands not easily abradable even as a result of long-term service. Hence, even when the resin coat layer surface has been abraded at its microscopically uneven portions, it is apt to be uniformly abraded. Hence, the microscopic unevenness profile is maintained and the composition and the properties of the resin coat layer surface stand not easily changeable even as a result of long-term service.

The graphitized particles used in the present invention may preferably have the degree of graphitization p(002) of from 0.20 to 0.95, which may more preferably be from 0.25 to 0.75, and still more preferably be from 0.25 to 0.70.

If the graphitized particles have a degree of graphitization p(002) of more than 0.95, the resin coat layer may have a good wear resistance, but may have low conductivity and lubricity to cause charge-up of toner and melt adhesion of toner, tending to cause a deterioration of image quality, such as sleeve ghosts, fog and a decrease of image density. Especially where the elastic blade and the toner having a high sphericity are used in combination in the developing step, lines and density non-uniformity are liable to appear in images because of the melt adhesion of toner. If on the other hand the graphitized particles have a degree of graphitization p(002) of less than 0.20, the coat layer surface may have a low wear resistance because of a low hardness of the graphitized particles, so that the profile of microscopic unevenness provided by the graphitized particles at the coat layer surface may no longer be maintained and further the coat layer surface may change in composition, causing the charge-up of toner and the melt adhesion of toner.

In the measurement of the degree of graphitization p(002), using a powerful full-automatic X-ray diffraction instrument "MXP18" system, manufactured by McScience Inc., the lattice spacing d(002) obtained from an X-ray diffraction spectrum of graphite is measured, and the degree of graphitization p(002) is found by $d(002)=3.440-0.086\times(1-p(002)^2)$.

To determine the lattice spacing d(002), CuKα is used as an X-ray source, where CuKβ rays are removed using a nickel filter. High-purity silicon is used as a standard substance. The lattice spacing d(002) is calculated from peak positions of C(002) and Si(111) diffraction patterns. Primary measuring conditions are as follows:

X-ray generator: 18 kw.
Goniometer: Horizontal goniometer.
Monochrometer: is used.
Tube voltage: 30.0 kV.
Tube current: 10.0 mA.
Measuring method: Continuous method.
Scanning axis: 2θ/θ.
Sampling interval: 0.020 deg.
Scanning speed: 6.000 deg/min.
Divergence slit: 0.50 deg.
Scatter slit: 0.50 deg.
Receiving slit: 0.30 mm.
Scanning axis: 2θ/θ.

As for a method for obtaining the graphitized particles having the degree of graphitization p(002), a method as shown below is preferable. The method is not necessarily limited to the following.

As to a method for obtaining especially preferable graphitized particles used in the present invention, graphitization is effected using, as a raw material, particles which are optically anisotropic and are composed of a single phase, such as mesocarbon microbeads or bulk-mesophase pitch. This is preferable in order for the graphitized particles to have a high degree of graphitization and to retain appropriate hardness and dispersibility while maintaining lubricity.

Optical anisotropy of the above raw material comes from stacks of aromatic molecules, and its orderliness develops further by graphitization treatment, so that the graphitized particles having a high degree of graphitization can be obtained.

In the case where the bulk-mesophase pitch is used as the raw material from which the graphitized particles used in the present invention are to be obtained, a bulk-mesophase pitch capable of softening and melting with heating may preferably be used in order to obtain graphitized particles which are particulate, have a high dispersibility and have a high degree of graphitization.

In a typical method for obtaining the bulk-mesophase pitch, e.g., β-resin is extracted from coal-tar pitch by solvent fractionation, and subjected to hydrogenation, heavy-duty treatment, to produce the bulk-mesophase pitch. The bulk-mesophase pitch may also be obtained by finely pulverizing the β-resin after the heavy-duty treatment in the above method and then removing the solvent-soluble matter using benzene or toluene.

This bulk-mesophase pitch may preferably have 95% by mass or more of quinoline-soluble matter. If one having less than 95% by mass of the same is used, the interiors of particles can not easily be liquid-phase carbonized and may become solid-phase carbonized, and hence the particles formed are kept in a crushed state. Thus, the particles may be non-uniform in shape and tend to cause faulty dispersion.

A method for graphitizing the mesophase pitch obtained as described above is described below. First, the bulk-mesophase pitch is finely pulverized into a size of from 2 to 25 μm, and the particles obtained are subjected to heat treatment in air at about 200° C. to 350° C., and then subjected to oxidation treatment to a slight degree. This oxidation treatment makes the bulk-mesophase pitch particles infusible only at their surfaces, and the particles are prevented from melting or fusing at the time of heat treatment for graphitization in the next step. The bulk-mesophase pitch particles having been subjected to oxidation treatment may preferably have an oxygen content of from 5 to 15% by mass. If they have an oxygen content of less than 5% by mass, particles tend to greatly fuse one another at the time of heat treatment, which is undesirable. If they have an oxygen content of more than 15% by mass, particles may be oxidized up to their interiors, and graphitized as their shape is in a crushed state, undesirably resulting in a low dispersibility.

Next, the above bulk-mesophase pitch particles having been subjected to oxidation treatment are subjected to primary calcination at about 800° C. to 1,200° C. and subsequently to secondary calcination at about 2,000° C. to 3,500° C. in an inert atmosphere of nitrogen or argon to produce the desired graphitized particles.

As to a method for obtaining the mesocarbon microbeads, another preferable raw material for obtaining the graphitized particles used in the present invention, a typical method is exemplified below. First, coal type heavy oil or petroleum type heavy oil is subjected to heat treatment at a temperature of from 300° C. to 500° C. to effect polycondensation to form crude mesocarbon microbeads. Then, the reaction product obtained is subjected to treatment such as filtration, sedimentation by leaving at rest, or centrifugation, to separate mesocarbon microbeads, followed by washing with a solvent such as benzene, toluene or xylene, and drying to produce the mesocarbon microbeads.

In graphitizing the mesocarbon microbeads thus obtained, the mesocarbon microbeads having been dried are first kept in a mechanically primarily dispersed state by force mild enough not to break them. This is preferable in order to prevent particles from coalescing after graphitization and to attain uniform particle size.

The mesocarbon microbeads having been primarily dispersed are subjected to primary calcination at a temperature of from 200° C. to 1,500° C. in an inert atmosphere to undergo carbonization. The carbonized product having been subjected to primary calcination is also mechanically dispersed by force mild enough not to break them. This is preferable in order to prevent particles from coalescing after graphitization or to attain uniform particle size.

The carbonized product having been subjected to primary dispersion treatment are subjected to secondary heat treatment at a temperature of from about 2,000° to 3,500° C. in an inert atmosphere to produce the desired graphitized particles.

In order to provide the resin coat layer with a uniform surface profile, it is preferable that even the graphitized particles thus produced from any of the above raw materials and by any of the above methods are uniformized to a certain extent by classification.

In the methods for forming graphitized particles by using any raw materials, the graphitized particles may preferably be graphitized at a firing temperature of from 2,000° C. to 3,500° C., and more preferably from 2,300° C. to 3,200° C.

If the graphitization is carried out at a calcining temperature of less than 2,000° C., the graphitized particles may have an insufficient degree of graphitization, and have low conductivity and lubricity to cause the charge-up of toner and the melt adhesion of toner, tending to cause a deterioration of image quality, such as sleeve ghosts, fog and image density decrease. Especially where the elastic blade and the toner having a high sphericity are used in combination in the developing step, lines and density non-uniformity tend to appear in images because of the melt adhesion of toner. If on the other hand the calcining temperature is more than 3,500° C., the graphitized particles may have too high a degree of graphitization, and hence the graphitized particles may have a low hardness. Thus, the coat layer surface may have a low wear resistance because of such a low hardness of the graphitized particles, so that the profile of microscopic unevenness provided by the graphitized particles at the coat layer surface can not be maintained and further the coat layer surface may change in composition, to cause the charge-up of toner and the melt adhesion of toner.

In the present invention, the graphitized particles dispersed in the coat layer of the developer carrying member may preferably have a volume average particle diameter of 3.0 μm or less. If the volume average particle diameter is more than 3.0 μm, the effect of providing fine unevenness may be lessened to tend to make surface roughness non-uniform, so that no uniform charging may be provided to the toner. In addition, during long-term service, the coat layer tends to wear non-uniformly and image density non-uniformity, contamination by toner, melt adhesion of toner and so forth tend to be caused by such worn portions. Even if the graphitized particles have a volume average particle diameter of 3.0 μm or less, where particles of 10 μm or more in diameter are present in a large proportion, besides the phenomena as stated above, blade scratches may come about during long-term service in the case where the elastic blade is used. As a result, lines and density non-uniformity appear in images in some cases. Accordingly, such coarse particles are preferably adjusted to be 3.0% or less, and more preferably 1.0% or less, in volume distribution of the particles.

The developer carrying member in the present invention may further use lubricating particles dispersed in the resin coat layer. Such lubricating particles may include particles of graphite, molybdenum disulfide, boron nitride, mica, graphite fluoride, silver-niobium selenide, calcium chloride-graphite, talc, and fatty acid metal salts such as zinc stearate. Any of these lubricating particles may preferably have a volume average particle diameter of 3.0 μm or less in the resin coat layer, for the same reasons as in the conductive particles described above.

In the present invention, it is also preferable that solid particles for forming unevenness are added to the conductive resin coat layer in order to make surface roughness uniform and maintain appropriate surface roughness. Further, as the solid particles used in the present invention, spherical particles are preferred. Inasmuch as they are spherical particles, the desired surface roughness is achievable by their addition in a smaller quantity than amorphous particles, and at the same time an uneven surface having a uniform surface profile can be obtained.

It is preferable that the spherical particles used in the present invention have a volume average particle diameter of from 0.3 to 15 μm. The addition of such spherical particles brings about the effects of allowing the conductive resin coat layer surface in the developer carrying member in the present invention to retain a uniform surface roughness and of reducing a change in the surface roughness of the conductive resin coat layer even when the conductive resin coat layer surface has worn, and further brings about the effects of uniformly charging the toner because the toner layer thickness on the developer carrying member can not be easily changed, and not easily creating sleeve ghosts, lines and image non-uniformity as well as contamination by toner and melt adhesion of toner on the developer carrying member. Such effects can be brought out over a long period of time.

The spherical particles used in the present invention may preferably have the volume average particle diameter of from 0.3 to 15 μm, which may preferably be from 1 to 10 μm. Spherical particles having a volume average particle diameter of less than 0.3 μm are not preferable because the effect of providing the conductive resin coat layer with uniform surface roughness may be so small as to tend to cause the charge-up of toner and the sleeve contamination by toner and melt adhesion of toner as a result of the wear of the conductive resin coat layer, resulting in image deterioration due to sleeve ghosts and a decrease in image density. If the spherical particles have a number average particle diameter of more than 15 μm, the conductive resin coat layer has too large surface roughness and the toner is transported in a large quantity, so that the toner is not uniformly applied on the developing sleeve surface and is difficult to uniformly charge. Also, coarse particles may protrude to cause image lines, and white dots or black dots due to bias leak. Further, the conductive resin coat layer may have a low mechanical strength. Thus, such particles are undesirable.

The "spherical" in the spherical particles used in the present invention refers to "nearly spherical" in which a major axis/minor axis ratio is approximately from 1.0 to 1.5. In the present invention, it is preferable to use particles having a major axis/minor axis ratio of from 1.0 to 1.2, and particularly preferable to use truly spherical particles. If the spherical particles have a major axis/minor axis ratio of more than 1.5, the dispersibility of the spherical particles in the resin coat layer may be lowered and the spherical particles must be added in a somewhat larger quantity in order to attain the desired surface roughness, so that the conductive resin coat layer may have a non-uniform surface profile. This is undesirable in view of the uniform charging of the toner and the strength of the conductive resin coat layer.

As the spherical particles used in the present invention, any conventionally known spherical particles may be used as long as they have the volume average particle diameter of from 0.3 to 15 μm. For example, they may include spherical resin particles, spherical metal oxide particles and spherical carbide particles. Of these, the spherical resin particles are preferred because, when added to the conductive resin coat layer, a preferable surface roughness is achievable by its addition in a smaller quantity and also a uniform surface profile can be obtained with ease. The spherical particles usable in the present invention may readily obtained by, e.g., suspension polymerization, dispersion polymerization or the like. Resin particles obtained by pulverization may be subjected to thermal or physical sphering treatment to make them spherical, and such particles may of course be used.

Spherical resin particles preferable in the present invention may specifically include, e.g., particles of acrylic resins such as polyacrylate and polymethacrylate, particles of polyamide resins such as nylon, particles of polyolefin resins such as polyethylene and polypropylene, silicone resin particles, phenolic resin particles, polyurethane resin particles, styrene resin particles and benzoguanamine resin particles; which are spherical particles produced using commonly known resins.

The spherical particles used in the present invention enumerated above may be those the surfaces of which an inorganic fine powder has adhered or sticked to. For example, the surfaces of the spherical resin particles may be treated with such inorganic fine powder as shown below, whereby the dispersibility of the spherical particles in the conductive resin coat layer can be improved and it is possible to improve the uniformity of the surface of the coat layer to be formed, stain resistance of the coat layer, charge-providing performance to the toner, wear resistance of the coat layer, and so forth.

As the inorganic fine powder usable in this case, the following may be cited: Fine powders of oxides such as $SiO_2$, $SrTiO_3$, $CeO_2$, CrO, $Al_2O_3$, ZnO and MgO, nitrides such as $Si_3N_4$, carbides such as SiC, sulfates and carbonates such as $CaSO_4$, $BaSO_4$ and $CaCO_3$. Such inorganic fine powders may have been treated with a coupling agent. That is, in particular, for the purpose of improving adherence to the binder resin or for the purpose of providing particles with hydrophobicity, it is preferable to use an inorganic fine powder having been treated with a coupling agent.

The coupling agent used in this case may include, e.g., a silane coupling agent, a titanium coupling agent and a zircoaluminate coupling agent. The silane coupling agent may include the following: Hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilyl mercaptan, trimethylsilyl mercaptan, triorganosilyl acrylate, vinyldimethylacetoxysilane, dimethyldiethoxysilane, dimethyldimethoxysilane, diphenylethoxysilane, hexamethyldisiloxane, 1,3-divinyltetramethyldisiloxane, 1,3-diphenyltetramethyldisiloxane, and a dimethylpolysiloxane having 2 to 12 siloxane units per molecule and containing a hydroxyl group bonded to one silicon atom for each terminal unit.

In addition, as the spherical particles, it is preferable in the present invention to use particles having a true density of 3 g/cm$^3$ or less. It is also preferable in the present invention to use conductive particles as the spherical particles. More specifically, conductive spherical particles having a true density of 3 g/cm$^3$ or less may preferably be used. By imparting conductivity to the spherical particles in this way, charges are difficult to accumulate on the particle surfaces because of the conductivity, as compared with insulating particles. Accordingly, when the conductive resin coat layer contains such conductive spherical particles, the effect of uniforming the surface roughness throughout long-term service is exhibited, and the adhesion of toner particles to the coat layer are reduced. Thus, sources causative of sleeve contamination by toner and the melt adhesion of toner are further reduced, thereby improving the charge-providing performance to toner and developing performance together with the effect brought about by the quaternary ammonium salt compound described previously.

The spherical particles used in the present invention may have the true density of 3.0 g/cm$^3$ or less, which may preferably be 2.7 g/cm$^3$ or less, and more preferably from 0.9 to 2.5 g/cm$^3$. If the spherical particles have a true density of more than 3.0 g/cm$^3$, the particles must be added in a large quantity in order to provide a suitable surface roughness, and because of too large a difference in density between the particles and the binder resin, the dispersibility of the spherical particles in the conductive resin coat layer may be insufficient to make it difficult to provide the coat layer surface with uniform roughness, and make it difficult to provide the toner with uniform charge.

The "conductive" of the conductive spherical particles used in the present invention refers to a volume resistivity of $10^6$ Ωcm or less. The particles having a volume resistivity of from $10^{-6}$ to $10^3$ Ωcm may preferably be used. If the spherical particles have a volume resistivity of more than $10^6$ Ωcm, the effect of making the particles conductive may be lost. That is, the effect is not exhibited in which spherical particles exposed to the conductive resin coat layer surface due to wear are kept from serving as nuclei around which the sleeve contamination by toner and the melt adhesion of toner may occur.

The volume resistivity of the above particles is measured in the following way. A particulate sample is put in an aluminum ring of 40 mm diameter, and then press-molded under 2,500 N. The volume resistivity of the molded product obtained is measured with a resistivity meter LORESTAR AP or HIRESTAR IP (both manufactured by Mitsubishi Chemical Corporation), using a four-terminal probe. The measurement is made in an environment of 20° C. to 25° C. and 50% RH to 60% RH.

As methods for obtaining the conductive spherical particles used in the present invention, methods as described below are preferred, but they are not necessarily limited thereto. As a method for obtaining particularly preferable conductive spherical particles used in the present invention, for example, a method is available for example in which spherical resin particles or mesocarbon microbeads are calcined and thereby carbonized and/or graphitized to produce spherical carbon particles having low density and good conductivity. A resin material used in the spherical resin particles may include, e.g., the following: Phenolic resins, naphthalene resins, furan resins, xylene resins, divinylbenzene polymers, styrene-divinylbenzene copolymers, and polyacrylonitrile. The mesocarbon microbeads may usually be produced by subjecting spherical crystals formed in the course of heating and calcining a mesopitch, to washing with a large quantity of tar or a solvent such as middle oil or quinoline.

As a method for obtaining more preferable conductive spherical particles, a method is available in which the surfaces of spherical particles of a resin such as phenolic resin, naphthalene resin, furan resin, xylene resin, divinylbenzene polymer, styrene-divinylbenzene copolymer or polyacrylonitrile are coated with a bulk-mesophase pitch by a mechanochemical method, and the particles thus coated are heated in an oxidative atmosphere, followed by calcining so as to be carbonized and/or graphitized to produce conductive spherical carbon particles.

The conductive spherical carbon particles obtained by the above methods may preferably be used in the present invention because, in any of the above methods, the conductivity of the spherical carbon particles to be obtained can be controlled to a certain extent by changing conditions for calcination. In order to more improve the conductivity, to the spherical carbon particles obtained by the above methods, conductive metal and/or metal oxide plating may optionally be applied to such an extent that the true density of the conductive spherical particles does not exceed 3.0 g/cm$^3$.

As another method for obtaining the conductive spherical particles used in the present invention, a method is available in which, conductive fine particles having smaller particle diameters than core particles composed of spherical resin particles are mechanically mixed in a suitable mixing ratio with respect to the core particles, to cause the conductive fine particles to adhere uniformly to the peripheries of the core particles by the action of van der Waals force and electrostatic force, and thereafter the surfaces of the core particles are softened by, e.g., local temperature rise resulting from applying mechanical impact force so that the conductive fine particles form coats on the core particle surfaces, to obtain conductive-treated spherical resin particles.

As the above core particles, it is preferable to use spherical resin particles composed of an organic compound and having a small true density. The resin therefor may include, e.g., the following: PMMA, acrylic resins, polybutadiene resins, polystyrene resins, polyethylene, polypropylene, polybutadiene, or copolymers of any of these, benzoguanamine resins, phenolic resins, polyamide resins, nylons, fluorine resins, silicone resins, epoxy resins and polyester resins. As the conductive fine particles (small particles) used when they form coats on the surfaces of the core particles (base particles), it is preferable to use small particles having a particle diameter of ⅛ or less of the base particles so that the coats of conductive fine particles can uniformly be formed.

As another method for obtaining the conductive spherical particles usable in the present invention, a method is available in which the conductive fine particles are uniformly dispersed in spherical resin particles to thereby obtain conductive spherical particles with the conductive fine particles dispersed therein. As a method for uniformly dispersing the conductive fine particles in the spherical resin particles, available are, e.g., a method in which a binder resin and the conductive fine particles are kneaded to disperse the latter conductive fine particles in the former, and thereafter the product is cooled to solidify and then pulverized into particles having a stated particle diameter, followed by mechanical treatment and thermal treatment to obtain the conductive fine particles; and a method in which a polymerization initiator, the conductive fine particles and other additives are added to, and uniformly dispersed in, polymerizable monomers by means of a dispersion machine to obtain a monomer composition, then the monomer composition is suspended in an aqueous phase containing a dispersion stabilizer by means of a stirrer to be polymerized so as to provide a given particle diameter, producing spherical particles with conductive fine particles dispersed therein.

As to the conductive spherical particles with the conductive fine particles dispersed therein, obtained by these methods, the particles may be used after they are mechanically mixed with the above conductive fine particles having smaller particle diameters than the core particles, in a suitable mixing ratio to cause the latter conductive fine particles to adhere uniformly to the peripheries of the conductive spherical particles by the action of van der Waals force and electrostatic force and thereafter the surfaces of the conductive spherical particles with the conductive fine particles dispersed therein are softened by, e.g., local temperature rise caused by applying mechanical impact force so that the latter conductive fine particles may form coats on the conductive spherical particle surfaces, to obtain spherical resin particles with higher conductivity.

As in the foregoing, the spherical particles dispersed in the conductive resin coat layer of the developer carrying member in the present invention optimize the surface roughness of the developing sleeve surface and further uniformize the surface profile, to thereby uniform the toner layer transport power on the sleeve, and also keeps the surface roughness from changing when any wear comes about, to thereby keep the transport power from changing during long-term service. Further, the spherical particles bring about an improvement in rapid and uniform charge-providing performance and charge controllability, for the toner using the magnetic powder having a high saturated magnetization and a low residual magnetization as in the present invention, and hence the effect of preventing the charge-up and preventing the sleeve ghosts and the effect of preventing the sleeve contamination by toner and the melt adhesion of toner can be brought out over a long period of time. In particular, the spherical carbon particles may particularly preferably be used because they do not impair the conductivity of the conductive resin coat layer and prevent the toner adhesion or melt adhesion around particles serving as nuclei.

The particle diameter of the solid particles used to form the unevenness attributable to the graphitized particles is measured with Coulter LS-130 particle size distribution meter (manufactured by Coulter Electronics Inc.), which is a laser diffraction particle size distribution meter. As a measuring method, a small volume module is used. As a measuring solvent, isopropyl alcohol (IPA) is used. The inside of a measuring system of the particle size distribution meter is washed with the IPA for about 5 minutes, and background function is executed after the washing. Next, 1 to 25 mg of a measuring sample is added to 50 ml of IPA. The solution in which the sample has been suspended is subjected to dispersion by means of an ultrasonic dispersion machine for about 1 to 3 minutes to obtain a sample fluid. The sample fluid is little by little added to the interior of the measuring system of the above measuring instrument, and the sample concentration in the measuring system is so adjusted that the PIDS on the screen of the instrument to make a measurement is 45 to 55%. Then, number average particle diameter calculated from number distribution is determined.

In the present invention, the conductive resin coat layer formed on the developer carrying member may preferably have a volume resistivity of $10^4$ Ωcm or less, and more preferably $10^3$ Ωcm or less, in order to prevent the developer from sticking onto the developer carrying member because of the charge-up and to prevent the developer from being defectively provided with charges from the surface of the developer carrying member in conjunction with the charge-up of the developer. More specifically, if the coat layer has a volume resistivity of more than $10^4$ Ωcm, the developer is liable to be defectively provided with charges, so that blotches tends to occur.

The volume resistivity of the conductive resin coat layer is measured in the following way. A resin coat layer of 7 to 20 μm in thickness is formed on a PET sheet of 100 μm thickness, and the volume resistivity is measured with a resistivity meter LORESTAR AP (manufactured by Mitsubishi Chemical Corporation), using a four-terminal probe. The measurement is carried out in an environment of 20° C. to 25° C. and 50 to 60% RH.

In the developer carrying member in the present invention, the conductive resin coat layer surface may preferably have an arithmetic-average roughness Ra (hereinafter referred to also as "Ra") of from 0.2 to 1.2 μm, and more preferably from 0.3 to 1.0 μm. As long as the conductive resin coat layer surface has an Ra of 0.2 μm or more, the unevenness for sufficiently transporting the developer (toner) is easy to form on the conductive resin coat layer surface, and the developer level (toner level) on the developer carrying member is stabilized, and wear resistance and toner stain resistance of the conductive resin coat layer are improved.

As long as the conductive resin coat layer surface has an Ra of 1.2 μm or less, the developer (toner) can be transported on the developer carrying member in an appropriate level to make it easy for the developer (toner) to be uniformly charged, and also the conductive resin coat layer can be prevented from having low mechanical strength.

The arithmetic-average roughness Ra of the conductive resin coat layer surface is measured according to JIS B 0601 "Surface Roughness", using SURFCORDER SE-3500, manufactured by Kosaka Laboratory, Ltd. The measurement is performed under conditions of a cut-off of 0.8 mm, an evaluation length of 4 mm and a feed rate of 0.5 mm/s, and at 9 spots (3 spots in the peripheral direction for each of 3 spots taken at regular intervals in the axial direction), and the measurement values are averaged.

In order to control the Ra of the conductive resin coat layer to be from 0.2 to 1.2 μm, it is preferable to apply a means of selecting the volume average particle diameter as described previously in regard to the solid particles for forming the unevenness which are used in the conductive resin coat layer.

The developer carrying member used in the present invention is constituted as described below in greater detail.

The developer carrying member in the present invention consists basically of a substrate and the resin coat layer.

The substrate of the developer carrying member includes a cylindrical member, a columnar member and a belt-like member. In the present invention, a cylindrical tube or solid rod of a rigid material such as a metal may preferably be used. In particular, what may preferably be used is a non-magnetic metal or alloy such as aluminum, stainless steel or brass which has been molded in a cylindrical or columnar shape and then subjected to abrasion, grinding or the like. Where the resin coat layer on the developer carrying member surface has flexibility as in the present invention, the developer carrying member may be deflected due to pressing force of a developer layer thickness control member, a developer feed member and so force to make appropriate development unperformable. In the case of what is called a jumping development system, in which the developer carrying member is not in contact with the electrostatic latent image bearing member at the developing zone, the gap between the developer carrying member and the electrostatic latent image bearing member (hereinafter referred to also as "S-D gap" may vary because of the above deflection, so that the developer may not appropriately be fed to the electrostatic latent image bearing member. In particular, at the middle portion of the developer carrying member, at which it is greatly deflected, the S-D gap may become so narrow as to cause a leak of electric charges. Using the substrate made of a rigid body as described above, stable development can be performed without creating any image density decrease and density non-uniformity.

Such a substrate is used after having been shaped or worked in a high precision in order to improve the uniformity of images to be formed. For example, the substrate may preferably be 30 μm or less, more preferably 20 μm or less, and still more preferably 10 μm or less, in straightness in its lengthwise direction. The substrate may also preferably be 30 μm or less, more preferably 20 μm or less, and still more preferably 10 μm or less, in fluctuation of the gap between the sleeve and the photosensitive drum, e.g., in fluctuation of the gap formed between the sleeve and a vertical face where the substrate is abutted against the vertical face via a uniform spacer and the sleeve is rotated. Aluminum may preferably be used in view of material cost and easiness of process.

To the surface of the developer carrying member substrate, blast finishing may be applied in order to improve developer transport performance. Specifically, using a blasting material such as spherical glass beads (by no means limited to this), the glass beads may be sprayed against the substrate surface from blast nozzles at a given pressure for a given time to form a large number of dimples on the developer carrying member surface.

As the binder resin for the conductive resin coat layer of the developer carrying member in the present invention, any of commonly known resins may be used, which may include, e.g., the following: Thermo- or photo-curing resins such as phenolic resins, epoxy resins, polyester resins, alkyd resins, melamine resins, benzoguanamine resins, polyurethane resins, urea resins, silicone resins and polyimide resins; thermoplastic resins such as styrene resins, vinyl resins, polyether sulfone resins, polycarbonate resins, polyphenylene oxide resins, polyamide resins, fluorine resins, cellulose resins and acrylic resins. In particular, the following is preferably used: resins having good mechanical properties, such as phenolic resins, polyether sulfone resins, polycarbonate resins, polyphenylene oxide resins, polyamide resins, polyester resins, polyurethane resins, styrene resins and acrylic resins; or resins having releasability, such as silicone resins and fluorine resins. Phenolic resins, silicone resins, polyamide resins, acrylic resins, epoxy resins, melamine resins, benzoguanamine resins and so forth are further preferred also from the viewpoint of providing the developer with triboelectric charges.

An example of an image forming apparatus usable in the present invention is specifically described below with reference to FIG. 3.

Figure 3:
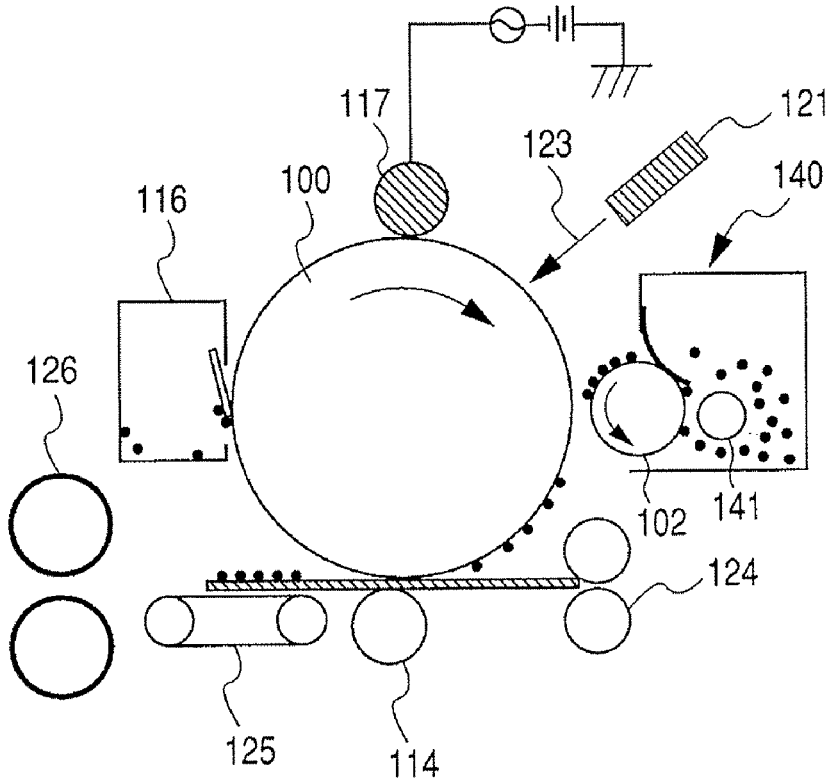
FIG. 3 is a diagrammatic view showing an example of the image forming method in the present invention.

In FIG. 3, reference numeral 100 denotes a photosensitive drum, around which a primary charging roller 117, a developing assembly 140, a transfer charging roller 114, a cleaner 116, a registration roller 124 and so forth are provided. Then, the photosensitive drum 100 is electrostatically charged to −600 V by means of the primary charging roller 117 (applied voltage: AC voltage of 2.0 kVpp and DC voltage of −620 Vdc), and then the photosensitive drum 100 is exposed by irradiation with laser light 123 by means of a laser generator 121. An electrostatic latent image formed on the photosensitive drum 100 is developed with a one-component magnetic toner by means of the developing assembly 140 to form a toner image, which is then transferred to a transfer material by means of the transfer roller 114 brought into contact with the photosensitive drum via the transfer material. The transfer material holding the toner image thereon is transported to a fixing assembly 126 by a transport belt 125, and the toner image is fixed onto the transfer material. The toner left partly on the photosensitive drum is removed by the cleaning means 116 to clean the surface.

EXAMPLES

The present invention is more specifically described below by giving production examples and working examples, which by no means limit the present invention.

Production of Magnetic Powder 1

In an aqueous ferrous sulfate solution, 1.0 to 1.1 equivalent weight of a sodium hydroxide solution, based on iron element, $P_2O_5$ in an amount making 0.15% by mass in terms of phosphorus element, based on iron element, and $SiO_2$ of 0.55% by mass in terms of silicon element, based on iron element, were mixed to prepare an aqueous solution containing ferrous hydroxide. The pH of this aqueous solution was adjusted to 8.0, and while air was blown into, oxidation reaction was carried out at 85° C. to prepare a slurry having seed crystals.

Next, an aqueous ferrous sulfate solution was so added to this slurry as to be from 0.9 to 1.2 equivalent weight based on the initial alkali quantity (sodium component of sodium hydroxide). Thereafter, while the pH of the slurry was kept at 7.6, and air was blown into, the oxidation reaction was allowed to proceed to obtain a slurry containing magnetic iron oxide. This slurry was filtered and washed and thereafter this water-containing slurry was taken out. At this point, this water-containing sample was collected in a small quantity to previously measure its water content. Then, without being dried, this water-containing sample was introduced into a different aqueous medium, and, with stirring and, at the same time, with circulation of the slurry, sufficiently re-dispersed by means of a pin mill, where the pH of the liquid re-dispersion was adjusted to about 4.8, and, with thorough stirring, an n-hexyltrimethoxysilane coupling agent was added in an amount of 1.5 parts by mass (the quantity of the magnetic iron oxide was found by subtracting the water content from the water-containing sample) based on 100 parts by mass of the magnetic iron oxide, and hydrolysis was carried out. Thereafter, with thorough stirring and, at the same time, with circulation of the slurry, dispersion was carried out by means of a pin mill, and the pH of the liquid dispersion was adjusted to about 8.9, where coupling treatment was carried out. The hydrophobic magnetic powder thus formed was filtered with a drum filter, and then washed sufficiently, followed by drying at 100° C. for 15 minutes and at 90° C. for 30 minutes. The resultant particles were subjected to disintegration treatment to obtain Magnetic Powder 1, having a volume average particle diameter (Dv) of 0.24 μm. Physical properties of Magnetic Powder 1 thus obtained are shown in Table 1.

Production of Magnetic Powder 2

Magnetic Powder 2 was obtained in the same manner as in Production of Magnetic Powder 1 except that the $P_2O_5$ and $SiO_2$ added were changed to $P_2O_5$ of 0.08% by mass in terms of phosphorus element and $SiO_2$ of 0.50% by mass in terms of silicon element. Physical properties of Magnetic Powder 2 thus obtained are shown in Table 1.

Production of Magnetic Powder 3

Magnetic Powder 3 was obtained in the same manner as in Production of Magnetic Powder 1 except that the amount of the air blown in the second-time oxidation reaction was reduced by 20%. Physical properties of Magnetic Powder 3 thus obtained are shown in Table 1.

Production of Magnetic Powder 4

Magnetic Powder 4 was obtained in the same manner as in Production of Magnetic Powder 1 except that the amount of the air blown in the second-time oxidation reaction was reduced by 35%. Physical properties of Magnetic Powder 4 thus obtained are shown in Table 1.

Production of Magnetic Powder 5

Magnetic Powder 5 was obtained in the same manner as in Production of Magnetic Powder 1 except that the amount of the air blown in the second-time oxidation reaction was increased by 30%. Physical properties of Magnetic Powder 5 thus obtained are shown in Table 1.

Production of Magnetic Powder 6

Magnetic Powder 6 was obtained in the same manner as in Production of Magnetic Powder 1 except that the $P_2O_5$ and $SiO_2$ added were changed to $P_2O_5$ of 0.03% by mass in terms of phosphorus element and $SiO_2$ of 0.2% by mass in terms of silicon element and that the amount of the air blown in the second-time oxidation reaction was reduced by 35%. Physical properties of Magnetic Powder 6 thus obtained are shown in Table 1.

Production of Magnetic Powder 7

Magnetic Powder 7 was obtained in the same manner as in Production of Magnetic Powder 1 except that the $P_2O_5$ and $SiO_2$ added were changed to $P_2O_5$ of 0.20% by mass in terms of phosphorus element and $SiO_2$ of 0.9% by mass in terms of silicon element. Physical properties of Magnetic Powder 7 thus obtained are shown in Table 1.

TABLE 1

| Magnetic powder | Residual magnetization ($Am^2/kg$) | Saturation magnetization ($Am^2/kg$) | Volume average particle diagram (μm) | P level | Si Level | P/Si |
|---|---|---|---|---|---|---|
| 1 | 3.3 | 70.1 | 0.24 | 0.15 | 0.55 | 0.27 |
| 2 | 4.1 | 71.2 | 0.25 | 0.08 | 0.50 | 0.16 |
| 3 | 2.6 | 68.1 | 0.31 | 0.15 | 0.55 | 0.27 |
| 4 | 2.3 | 65.8 | 0.37 | 0.15 | 0.55 | 0.27 |
| 5 | 5.4 | 71.3 | 0.13 | 0.15 | 0.55 | 0.27 |
| 6 | 4.3 | 67.8 | 0.38 | 0.03 | 0.20 | 0.15 |
| 7 | 2.9 | 69.5 | 0.25 | 0.20 | 0.90 | 0.22 |

Production of Polymer

Having Sulfonic Acid Group

Into a pressurizable reaction vessel having a reflux tube, a stirrer, a thermometer, a nitrogen feed pipe, a dropping unit and an evacuation unit, 250 parts by mass of methanol, 150 parts by mass of 2-butanone and 100 parts by mass of 2-propanol as solvents and 83 parts by mass of styrene, 12 parts by mass of butyl acrylate and 4 parts by mass of 2-acrylamido-2-methylpropanesulfonic acid (hereinafter "AMPS") as monomers were introduced, and then heated to reflux temperature with stirring. A solution prepared by diluting 0.45 part by mass of a polymerization initiator t-butyl peroxy-2-ethylhexanoate with 20 parts by mass of 2-butanone was dropwise added thereto over a period of 30 minutes, and the stirring was continued for 5 hours, to which a solution prepared by diluting 0.28 part by mass of t-butyl peroxy-2-ethylhexanoate with 20 parts by mass of 2-butanone was further dropwise added over a period of 30 minutes, followed by stirring for further 5 hours to carry out polymerization.

Thereafter, the reaction mixture was introduced into methanol to allow a polymer to precipitate. The polymer obtained had a glass transition temperature (Tg) of 70.4° C. and a weight average molecular weight of 23,000.

Production of Magnetic Toner T1

In 720 parts by mass of ion-exchange water, 450 parts by mass of an aqueous 0.1-M $Na_3PO_4$ solution was introduced, followed by heating to 60° C. Thereafter, to the resultant mixture, 67.7 parts of an aqueous 1.0-M $CaCl_2$ solution was added to obtain an aqueous medium containing a dispersion stabilizer.

| | (by mass) |
|---|---|
| Styrene | 74 parts |
| n-Butyl acrylate | 26 parts |
| Divinylbenzene | 0.50 part |
| Saturated polyester resin (a reaction product of terephthalic acid with an ethylene oxide addition product of bisphenol A; Mn: 4,000; Mw/Mn: 2.8; acid value: 11 mgKOH/g) | 10 parts |
| Polymer Having Sulfonic Acid Group | 1.5 parts |
| Polar compound (1) (In the above formula (2), n: 9, A: —$CH_2CH_2$—, R: methyl group, x:y:z = 50:40:10; saponification value: 150; peak molecular weight Mp: 3,000) | 0.1 part |
| Magnetic Powder 1 | 90 parts |

The above formulation was uniformly dispersed and mixed by means of an attritor (manufactured by Mitsui Miike Engineering Corporation). The monomer composition thus obtained was heated to 60° C., and 10 parts of paraffin wax (maximum endothermic peak in DSC: 78° C.) was added thereto and mixed and dissolved. To the mixture obtained, 5 parts of a polymerization initiator 2,2'-azobis(2,4-dimethylvaleronitrile) was dissolved to prepare a polymerizable monomer composition.

The polymerizable monomer composition was introduced into the above aqueous medium, followed by stirring for 10 minutes at 60° C. in an atmosphere of $N_2$, using TK type homomixer (manufactured by Tokushu Kika Kogyo Co., Ltd.) at 12,000 rpm to carry out granulation. Thereafter, while the granulated product obtained was stirred with a paddle stirring blade, the reaction was carried out at 60° C. for 8 hours. After the reaction was completed, the suspension formed was cooled, and hydrochloric acid was added thereto to adjust the pH to 0.8, followed by stirring for 2 hours and thereafter filtration. The resulting product was washed with 2,000 parts by mass or more of iron-exchange water three times, followed by sufficient aeration and thereafter drying to obtain Toner Particles 1.

To 100 parts by mass of this Toner Particles 1, 1.0 part by mass of hydrophobic fine silica powder obtained by treating silica of 12 nm in number average primary particle diameter with hexamethyldisilazane and thereafter with silicone oil and having a BET specific surface area of 120 $m^2/g$ was added and mixed by means of a Henschel mixer (manufactured by Mitsui Miike Engineering Corporation) to obtain Magnetic Toner T1 having a weight average particle diameter of 6.5 μm. Physical properties of Magnetic Toner T1 are shown in Table 2.

Production of Magnetic Toner T2

Magnetic Toner T2 was obtained in the same manner as in Production of Magnetic Toner T1 except that Magnetic Powder 2 was used in place of Magnetic Powder 1. Physical properties of Magnetic Toner T2 are shown in Table 2.

Production of Magnetic Toner T3

Magnetic Toner T3 was obtained in the same manner as in Production of Magnetic Toner T1 except that Magnetic Powder 3 was used in place of Magnetic Powder 1. Physical properties of Magnetic Toner T3 are shown in Table 2.

Production of Magnetic Toner T4

Toner particles were obtained in the same manner as in Production of Magnetic Toner T1 except that Magnetic Powder 1 was not added. To 100 parts of the toner particles obtained, 45 parts of Magnetic Powder 1 was externally added, and iron oxide particles were stuck to the toner particle surfaces by means of an impact type surface treating apparatus (treating temperature: 55° C.; peripheral speed of rotary treating blade: 90 m/sec) to produce iron-oxide-stuck toner particles.

To 100 parts of the iron-oxide-stuck toner particles produced, 20 parts of emulsified particles (particle diameter: 0.05 μm) composed of a styrene-methacrylic acid copolymer and 45 parts of Magnetic Powder 1 were externally added. Thereafter, the emulsified particles and the iron oxide particles were allowed to adhere to, and form coats on, the toner particles by means of the impact type surface treating apparatus (treating temperature: 55° C.; peripheral speed of rotary treating blade: 90 m/sec) to produce coated toner particles.

To 100 parts by mass of the coated toner particles thus obtained, 1.0 part by mass of hydrophobic fine silica powder obtained by treating silica of 12 nm in number average primary particle diameter with hexamethyldisilazane and thereafter with silicone oil and having a BET specific surface area of 120 $m^2/g$ was added and mixed in the same manner as in Magnetic Toner T1 to produce Magnetic Toner T4, having a weight average particle diameter of 7.2 μm. Physical properties of Magnetic Toner T4 are shown in Table 2.

Production of Magnetic Toner T5

100 parts of Styrene-n-butyl acrylate copolymer (monomer ratio: 78/22; Mn: 25,000; Mw/Mn: 2.5), 2 parts of saturated polyester resin, 5 parts of the polymer having sulfonic acid groups produced as described above, 90 parts of Magnetic Powder 1, 0.07 part of the polar compound (1) and 5 parts of ester wax (maximum-value temperature of endothermic peak in DSC: 72° C.) were mixed by means of a Henschel mixer. Thereafter, the resulting mixture was melt-kneaded by means of a twin-screw extruder. The kneaded product was cooled and crushed using a hammer mill to produce a toner crushed product. This crushed product was finely pulverized by means of a jet mill. Thereafter, the finely pulverized product obtained was air-classified to obtain toner particles with a weight average particle diameter of 6.6 μm.

To 100 parts of the toner particles thus obtained, 1.0 part of the same silica as used for Magnetic Toner T1 was added, and mixed by means of a Henschel mixer to obtain Magnetic Toner T5. Physical properties of this Magnetic Toner T5 are shown in Table 2.

Production of Magnetic Toners T6 to T9

Magnetic Toners T6 to T9 were produced in the same manner as in Production of Magnetic Toner T1 except that Magnetic Powders 4 to 7, respectively, were used in place of Magnetic Powder 1. Physical properties of Magnetic Toners T6 to T9 are shown in Table 2.

Production of Magnetic Toner T10

To 100 parts Toner Particles 1 obtained in Production of Magnetic Toner T1, 25 parts of emulsified particles (styrene-methacrylic acid copolymer; particle diameter: 0.05 μm) were externally added. Thereafter, the emulsified particles were allowed to adhere to, and form coats on, the toner particles by means of the impact type surface treating apparatus (treating temperature: 50° C.; peripheral speed of rotary treating blade: 90 m/sec) to produce coated toner particles.

To 100 parts by mass of the coated toner particles thus obtained, 1.0 part of the same silica as used for Magnetic Toner T1 was added, and mixed by means of a Henschel mixer to produce Magnetic Toner T10. Physical properties of this Magnetic Toner T10 are shown in Table 2.

TABLE 2

| Magnetic Toner | Proportion to whole toner particles, of toner particles satisfying structure wherein, in respect to whole magnetic oxide particles, at least 70% by number of the magnetic iron oxide particles are present in depth 0.2 times the projected-area-equivalent diameter C from the surfaces of toner particles (% by number) | Average Circularity | Weight average particle diagram (μm) | Magnetic powder used |
|---|---|---|---|---|
| T1 | 82 | 0.985 | 6.9 | 1 |
| T2 | 77 | 0.981 | 7.1 | 2 |
| T3 | 75 | 0.979 | 6.5 | 3 |
| T4 | 98 | 0.978 | 7.2 | 1 |
| T5 | 5 | 0.957 | 6.6 | 1 |
| T6 | 78 | 0.981 | 6.7 | 4 |
| T7 | 80 | 0.981 | 6.8 | 5 |
| T8 | 76 | 0.984 | 7.1 | 6 |
| T9 | 83 | 0.988 | 6.9 | 7 |
| T10 | 51 | 0.971 | 7.3 | 1 |

Production of Developer Carrying Member S1

A coating fluid for the resin coat layer to be formed on the developing sleeve surface was prepared.

| | |
|---|---|
| Resol type phenolic resin produced in the presence of ammonia as a catalyst (50% methanol solution) | 400 parts |
| Carbon black | 100 parts |
| Isopropyl alcohol | 500 parts |

The above materials were subjected to dispersion by means of a sand mill using glass beads of 1 mm in diameter as media particles, to prepare Coating Material Intermediate M1. This Coating Material Intermediate M1 had a volume average particle diameter of 0.32 μm. Next, to 100 parts by mass of Coating Material Intermediate M1, 10 parts by mass of resol type phenolic resin produced in the presence of ammonia as a catalyst (50% methanol solution), 6 parts by mass of Roughening Particles B1 and 20.6 parts by mass of isopropyl alcohol were added, and subjected to dispersion by means of a sand mill using glass beads of 2 mm in diameter as media particles, to prepare Coating Fluid P1.

As Roughening Particles B1, Conductive Spherical Carbon Particles R1 of 6.3 μm in volume average particle diameter were used which were obtained in the following way. 100 parts of spherical phenolic resin particles of 5.5 μm in volume average particle diameter were uniformly coated with 14 parts of coal type bulk-mesophase pitch powder of 2 μm or less in volume average particle diameter by means of an automated mortar (automatic stone mill, manufactured by Ishikawa Kojo), followed by heat stabilization treatment in air at 280° C. and thereafter calcination at 2,000° C. in an atmosphere of nitrogen, further followed by classification.

Using the above Coating Fluid P1, a conductive resin coat layer was formed by spray coating on the surface of a cylindrical tube of 16 mm in outer diameter, made of aluminum, and subsequently heated at 150° C. for 30 minutes by means of a hot-air dryer to be cured to produce Developer Carrying Member S1. Physical properties of Developer Carrying Member S1 are shown in Table 3.

Production of Developer Carrying Member S2

| | |
|---|---|
| Resol type phenolic resin produced in the presence of ammonia as a catalyst (50% methanol solution) | 350 parts |
| Carbon black | 70 parts |
| Graphitized Particles A1 | 70 parts |
| Isopropyl alcohol | 510 parts |

The above materials were subjected to dispersion by means of a sand mill using glass beads of 1 mm in diameter as media particles, to prepare Coating Material Intermediate M2. This Coating Material Intermediate M2 had a volume average particle diameter of 0.92 μm.

As graphitized particles, Graphitized Particles A1 of 3.1 μm in volume average particle diameter were used which were obtained in the following way. β-resin was extracted from coal-tar pitch by solvent fractionation and subjected to hydrogenation, heavy-duty treatment. Thereafter, the solvent-soluble matter was removed with toluene to produce a mesophase pitch. Its bulk mesophase pitch powder was finely pulverized, and subjected to oxidation treatment at about 300° C. in air, followed by heat treatment at 3,000° C. in an atmosphere of nitrogen and further followed by classification.

Next, to 100 parts by mass of Coating Material Intermediate M2, 19.6 parts by mass of resol type phenolic resin produced in the presence of ammonia as a catalyst (50% methanol solution), 7 parts by mass of Roughening Particles B1 and 21.4 parts by mass of isopropyl alcohol were added, and subjected to dispersion by means of a sand mill using glass beads of 2 mm in diameter as media particles, to prepare Coating Fluid P2.

Using the above Coating Fluid P2, Developer Carrying Member S2 was produced in the same manner as Developer Carrying Member S1. Physical properties of Developer Carrying Member S2 are shown in Table 3.

Production of Developer Carrying Member S3

| | |
|---|---|
| Resol type phenolic resin produced in the presence of ammonia as a catalyst (50% methanol solution) | 480 parts |
| Carbon black | 32 parts |
| Graphitized Particles A1 | 128 parts |
| Isopropyl alcohol | 360 parts |

The above materials were subjected to dispersion by means of a sand mill using glass beads of 1 mm in diameter as media particles, to prepare Coating Material Intermediate M3. This Coating Material Intermediate M3 had a volume average particle diameter of 2.08 μm.

Next, to 100 parts by mass of Coating Material Intermediate M3, 16 parts by mass of resol type phenolic resin produced in the presence of ammonia as a catalyst (50% methanol solution), 6.4 parts by mass of Roughening Particles B1 and 33 parts by mass of isopropyl alcohol were added, and subjected to dispersion by means of a sand mill using glass beads of 2 mm in diameter as media particles, to prepare Coating Fluid P3.

Using the above Coating Fluid P3, Developer Carrying Member S3 was produced in the same manner as in Developer Carrying Member S1. Physical properties of Developer Carrying Member S3 are shown in Table 3.

Production of Developer Carrying Member S4

| | |
|---|---|
| Resol type phenolic resin produced in the presence of ammonia as a catalyst (50% methanol solution) | 400 parts |
| Graphitized Particles A1 | 200 parts |
| Isopropyl alcohol | 400 parts |

The above materials were subjected to dispersion by means of a sand mill using glass beads of 1 mm in diameter as media particles, to obtain Coating Material Intermediate M4. This Coating Material Intermediate M4 had a volume average particle diameter of 2.81 μm.

Next, to 100 parts by mass of Coating Material Intermediate M4, 40 parts by mass of resol type phenolic resin produced in the presence of ammonia as a catalyst (50% methanol solution), 8 parts by mass of Roughening Particles B1 and 52 parts by mass of isopropyl alcohol were added, and subjected to dispersion by means of a sand mill using glass beads of 2 mm in diameter as media particles, to prepare Coating Fluid P4.

Using the above Coating Fluid P4, Developer Carrying Member S4 was produced in the same manner as in Developer Carrying Member S1. Physical properties of Developer Carrying Member S4 are shown in Table 3.

Production of Developer Carrying Member S5

Coating Fluid P5 was prepared in the same manner as in the preparation of Coating Fluid P1 except that Coating Fluid P1 was added in an amount of 2 parts by mass. Next, using Coating Fluid P5, Developer Carrying Member S5 was produced in the same manner as in Developer Carrying Member S1. Physical properties of Developer Carrying Member S5 are shown in Table 3.

Production of Developer Carrying Member S6

Developer Carrying Member S6 was produced in the same manner as in Developer Carrying Member S4 except that, in Developer Carrying Member S4, the solid matter concentration of the coating fluid was changed to 25% by diluting with isopropyl alcohol and the coating fluid was applied by dip coating. Physical properties of Developer Carrying Member S6 are shown in Table 3.

Production of Developer Carrying Member S7

Developer Carrying Member S7 was produced in the same manner as in Developer Carrying Member S5 except that, in Developer Carrying Member S5, the solid matter concentration of the coating fluid was changed to 20% by diluting with isopropyl alcohol and the coating fluid was applied by dip coating. Physical properties of Developer Carrying Member S7 are shown in Table 3.

Production of Developer Carrying Member S8

To 100 parts by mass of Coating Material Intermediate M1, 20 parts by mass of resol type phenolic resin produced in the presence of ammonia as a catalyst (50% methanol solution), 4 parts by mass of Roughening Particles B3 and 20.6 parts by mass of isopropyl alcohol were added, and subjected to dispersion by means of a sand mill using glass beads of 2 mm in diameter as media particles, to prepare Coating Fluid P8.

As Roughening Particles B3, Conductive Spherical Carbon Particles R2 of 13.4 μm in volume average particle diameter were used which were obtained in the following way. 100 parts of spherical phenolic resin particles of 12.5 μm in volume average particle diameter were uniformly coated with 14 parts of coal type bulk-mesophase pitch powder of 2 μm or less in volume average particle diameter by means of an automated mortar (automatic stone mill, manufactured by Ishikawa Kojo), followed by heat stabilization treatment in air at 280° C. and thereafter calcination at 2,000° C. in an atmosphere of nitrogen, further followed by classification.

Next, using Coating Fluid P8, Developer Carrying Member S8 was produced in the same manner as in Developer Carrying Member S1. Physical properties of Developer Carrying Member S8 are shown in Table 3.

Production of Developer Carrying Member S9

To 100 parts by mass of Coating Material Intermediate M3, 80 parts by mass of resol type phenolic resin produced in the presence of ammonia as a catalyst (50% methanol solution), 10.4 parts by mass of Roughening Particles B1 and 35.6 parts by mass of isopropyl alcohol were added, and subjected to dispersion by means of a sand mill using glass beads of 2 mm in diameter as media particles, to prepare Coating Fluid P9. Next, using Coating Fluid P9, Developer Carrying Member S9 was produced in the same manner as in Developer Carrying Member S1. Physical properties of Developer Carrying Member S9 are shown in Table 3.

Production of Developer Carrying Member S10

| | |
|---|---|
| Resol type phenolic resin produced in the presence of ammonia as a catalyst (50% methanol solution) | 480 parts |
| Carbon black | 32 parts |
| Crystalline graphite (volume average particle diameter: 4.6 μm) | 128 parts |
| Isopropyl alcohol | 360 parts |

The above materials were subjected to dispersion by means of a sand mill using glass beads of 1 mm in diameter as media particles, to prepare Coating Material Intermediate M5. This Coating Material Intermediate M5 had a volume average particle diameter of 3.76 μm.

Next, to 100 parts by mass of Coating Material Intermediate M5, 16 parts by mass of resol type phenolic resin produced in the presence of ammonia as a catalyst (50% methanol solution), 6.4 parts by mass of Roughening Particles B1 and 33 parts by mass of isopropyl alcohol were added, and subjected to dispersion by means of a sand mill using glass beads of 2 mm in diameter as media particles, to prepare Coating Fluid P10.

Using the above Coating Fluid P10, Developer Carrying Member S10 was produced in the same manner as in Developer Carrying Member S1. Physical properties of Developer Carrying Member S10 are shown in Table 3.

Production of Developer Carrying Member S11

Coating Material Intermediate M6 was obtained by carrying out dispersion in the same manner as in Coating Material Intermediate M5 except that crystalline graphite of 6.5 μm in volume average particle diameter was used in place of the crystalline graphite of 4.6 μm in volume average particle diameter. This Coating Material Intermediate M6 had a volume average particle diameter of 5.20 μm.

Next, to 100 parts by mass of Coating Material Intermediate M6, 16 parts by mass of resol type phenolic resin produced in the presence of ammonia as a catalyst (50% methanol solution), 6.4 parts by mass of Roughening Particles B1 and 33 parts by mass of isopropyl alcohol were added, and subjected to dispersion by means of a sand mill using glass beads of 2 mm in diameter as media particles, to prepare Coating Fluid P11.

Using the above Coating Fluid P11, Developer Carrying Member S11 was produced in the same manner as in Developer Carrying Member S1. Physical properties of Developer Carrying Member S11 are shown in Table 3.

Production of Developer Carrying Member S12

Coating Material Intermediate M7 was obtained by carrying out dispersion in the same manner as Coating Material Intermediate M5 except that crystalline graphite of 8.4 μm in volume average particle diameter was used in place of the crystalline graphite of 4.6 μm in volume average particle diameter. This Coating Material Intermediate M7 had a volume average particle diameter of 6.90 μm.

Next, to 100 parts by mass of Coating Material Intermediate M7, 16 parts by mass of resol type phenolic resin produced in the presence of ammonia as a catalyst (50% methanol solution) and 20 parts by mass of isopropyl alcohol were added, and subjected to dispersion by means of a sand mill using glass beads of 2 mm in diameter as media particles, to prepare Coating Fluid P12.

Using the above Coating Fluid P12, Developer Carrying Member S12 was produced in the same manner as in Developer Carrying Member S1. Physical properties of Developer Carrying Member S12 are shown in Table 3.

Production of Developer Carrying Member S13

Coating Material Intermediate M8 was obtained by carrying out dispersion in the same manner as in Coating Material Intermediate M5 except that crystalline graphite of 5.5 μm in volume average particle diameter was used in place of the crystalline graphite of 4.6 μm in volume average particle diameter. This Coating Material Intermediate M8 had a volume average particle diameter of 4.51 μm.

Next, to 100 parts by mass of Coating Material Intermediate M8, 16 parts by mass of resol type phenolic resin produced in the presence of ammonia as a catalyst (50% methanol solution), 6.4 parts by mass of Roughening Particles B1 and 33 parts by mass of isopropyl alcohol were added, and subjected to dispersion by means of a sand mill using glass beads of 2 mm in diameter as media particles, to prepare Coating Fluid P13.

Using the above Coating Fluid P13, Developer Carrying Member S13 was produced in the same manner as in Developer Carrying Member S1. Physical properties of Developer Carrying Member S13 are shown in Table 3.

Production of Developer Carrying Member S14

Coating Material Intermediate M9 was obtained by carrying out dispersion in the same manner as Coating Material Intermediate M5 except that crystalline graphite of 4.8 μm in volume average particle diameter was used in place of the crystalline graphite of 4.6 μm in volume average particle diameter. This Coating Material Intermediate M9 had a volume average particle diameter of 3.13 μm.

Next, to 100 parts by mass of Coating Material Intermediate M9, 16 parts by mass of resol type phenolic resin produced in the presence of ammonia as a catalyst (50% methanol solution), 6.4 parts by mass of Roughening Particles B1 and 33 parts by mass of isopropyl alcohol were added, and subjected to dispersion by means of a sand mill using glass beads of 2 mm in diameter as media particles, to prepare Coating Fluid P14.

Using the above Coating Fluid P14, Developer Carrying Member S14 was produced in the same manner as in Developer Carrying Member S1. Physical properties of Developer Carrying Member S14 are shown in Table 3.

Production of Developer Carrying Member S15

The surface of an aluminum cylindrical substrate of 16 mm in outer diameter was processed by sand blasting to produce Developer Carrying Member S15 of S/A=1.90 and Ra=0.81. Physical properties of Developer Carrying Member S15 shown in Table 3.

Production of Developer Carrying Member S16

The surface of an aluminum cylindrical substrate of 16 mm in outer diameter was processed by sand blasting to produce Developer Carrying Member S16 of S/A=2.92 and Ra=1.09. Physical properties of Developer Carrying Member S16 are shown in Table 3.

TABLE 3

| Developer carrying | Conductive particles | | | | Roughening particles | | Binder resin | | | Vol. av. particle | % of 10.0 μm or | Surface roughness |
|---|---|---|---|---|---|---|---|---|---|---|---|---|
| member: | 1 | pbm | 2 | pbm | | pbm | | pbm | S/A | diam. (μm) | more | Ra (μm) |
| S-1 | CbBk | 100 | — | — | R1 | 60 | PhnlRs | 250 | 1.24 | 0.32 | 0.50 | 0.77 |
| S-2 | CbBk | 50 | GtzPtcl | 50 | R1 | 50 | PhnlRs | 220 | 1.35 | 0.92 | 0.90 | 0.84 |
| S-3 | CbBk | 20 | GtzPtcl | 80 | R1 | 40 | PhnlRs | 200 | 1.41 | 2.08 | 1.60 | 0.86 |
| S-4 | — | — | GtzPtcl | 100 | R1 | 40 | PhnlRs | 200 | 1.54 | 2.93 | 2.40 | 0.94 |
| S-5 | CbBk | 100 | — | — | R1 | 20 | PhnlRs | 250 | 1.17 | 0.31 | 0.20 | 0.55 |
| S-6 | — | — | GtzPtcl | 100 | R1 | 40 | PhnlRs | 200 | 1.34 | 2.93 | 2.40 | 0.87 |
| S-7 | CbBk | 100 | — | — | R1 | 20 | PhnlRs | 250 | 1.08 | 0.31 | 0.20 | 0.47 |
| S-8 | CbBk | 100 | — | — | R2 | 40 | PhnlRs | 250 | 1.23 | 0.43 | 4.80 | 1.32 |
| S-9 | CbBk | 20 | GtzPtcl | 80 | R1 | 65 | PhnlRs | 400 | 1.36 | 1.84 | 0.56 | 0.78 |
| S-10 | CbBk | 20 | Graphite | 80 | R1 | 30 | PhnlRs | 200 | 1.60 | 3.76 | 3.35 | 0.95 |
| S-11 | CbBk | 20 | Graphite | 80 | R1 | 40 | PhnlRs | 200 | 1.91 | 5.20 | 7.80 | 1.12 |
| S-12 | CbBk | 20 | Graphite | 80 | — | — | PhnlRs | 200 | 2.64 | 6.90 | 8.20 | 0.78 |
| S-13 | CbBk | 20 | Graphite | 80 | R1 | 40 | PhnlRs | 200 | 1.71 | 4.51 | 5.69 | 1.05 |
| S-14 | CbBk | 20 | Graphite | 80 | R1 | 40 | PhnlRs | 200 | 1.57 | 3.13 | 2.69 | 0.97 |
| S-15 | Aluminum unprocessed tube is sand-blasted. | | | | | | | | 1.33 | — | — | 0.81 |
| S-16 | Aluminum unprocessed tube is sand-blasted. | | | | | | | | 2.11 | — | — | 1.09 |

CbBk: Carbon black
GtzPtcl: Graphitized particleds
PhnlRs: Phenolic resin
pbm: Parts by mass Example 1

Using the developer carrying member produced as described above, evaluation was made in the following way.

Developer Carrying Member S1 was set in a laser beam printer LASER JET 2300, manufactured by Hewlett-Packard Co., having the developing assembly shown in FIG. 1. As the toner, the above Magnetic toner 1 was used. As the developer layer thickness control member used in the developing assembly, a blade made of urethane as used in LASER JET 2300 was used, and its touch conditions were so changed as to be 40 g/cm (39.2 N/m) in linear pressure per 1 cm in the lengthwise direction of the developer carrying member.

As the development bias, the alternating electric field was set to be 1.6 kvpp and a frequency of 2,400 Hz, and the DC voltage (Vdc) was so set that development faithful to latent images were able to be faithfully developed (i.e., that line latent images of 200 μm and 4 dots were developed in a line width of 200 μm). In Example 1, the DC voltage was set to be −420 V.

Then, a test was conducted in which an image composed of 8-point A-letters, having a print percentage of 2%, was reproduced on 12,000 sheets in an intermittent mode in a low-temperature and low-humidity environment (L/L) of 15° C./10% RH and in a high-temperature and high-humidity environment (H/H) of 30° C./85% RH. As a result, high definition images were obtained which had an image density of 1.4 or more in all environments and were free of any fog and spots around line images before and after the durability test.

In addition, a test was conducted in which an image composed of 8-point A-letters, having a print percentage of 4%, was reproduced on 4,000 sheets in a continuous mode in a normal-temperature and normal-humidity environment (23° C., 60% RH), and the toner consumption (mg/page) was determined from a change in weight of the developing assembly before and after the durability test. As a result, the toner consumption was 33.2 mg/page, and was found to be vastly reduced as compared with conventional 50 to 55 mg/page.

The evaluation results in the high-temperature and high-humidity environment and in the low-temperature and low-humidity environment, and on the toner consumption in the normal-temperature and normal-humidity environment, are shown in Table 4. In all the evaluations, A4-size paper of 75 g/m$^2$ in basis weight was used as the recording medium. These evaluation results are shown in Table 4.

Examples 2 to 11

Using S2 to S10 and S14 as the developer carrying members and using T1 as the toner, evaluations were made in the same way as in Example 1. As a result, in all the cases, images on the level of no problem in practical use were obtained before and after the durability tests. These evaluation results are shown in Table 4.

Examples 12 to 18

Using S1 as the developer carrying member and using T2 to T5 and T8 to T10 as the toners, evaluations were made in the same way as in Example 1. As a result, in all the cases, images on the level of no problem in practical use were obtained before and after the durability tests. These evaluation results are shown in Table 4.

Comparative Examples 1 and 2

Using S1 as the developer carrying member and using T6 and T7 as the toners, evaluations were made in the same way as in Example 1. In Comparative Example 1, no serious problem occurred in the high-temperature and high-humidity environment, but fog appeared in the low-temperature and low-humidity environment. In Comparative Example 2, the toner came to deteriorate because of magnetic cohesion to cause a decrease in image density and spots around line images in the high-temperature and high-humidity environment. The toner consumption was also large. These evaluation results are shown in Table 4.

Comparative Examples 3 to 5

Using S11, S13 and S15 as the developer carrying members and using T6 as the toner, evaluations were made in the same way as in Example 1. As a whole, fog appeared in the low-temperature and low-humidity environment. In Comparative Examples 3 and 4, spots around line images and ghosts appeared in the high-temperature and high-humidity environment. In Comparative Example 5, image density came to decrease conspicuously because of the charge-up with the progress of image reproduction. These evaluation results are shown in Table 4.

Comparative Examples 6 and 7

Using S12 and S16 as the developer carrying members and using T7 as the toner, evaluations were made in the same way as in Example 1. As a whole, fog appeared in the low-temperature and low-humidity environment. In Comparative Example 6, fog appeared in the low-temperature and low-humidity environment, and the toner consumption was also large. In Comparative Example 7, image density came to decrease conspicuously because of the charge-up with the progress of image reproduction. These evaluation results are shown in Table 4.

Evaluation Items (1) Image Density:

In the image reproduction test, solid images were reproduced at the initial stage and at the finish of the durability test. Image densities at given 10 spots were measured, and the average value of the image densities measured was regarded as image density. The measurement was conducted with a reflection densitometer RD918 (manufactured by Macbeth Co.).

(2) Fog:

Fog density (%) was calculated from the difference between the whiteness of white background areas of printed images and the whiteness of a transfer sheet as measured with REFLECTOMETER MODEL TC-6DS (manufactured by Tokyo Denshoku Co., Ltd.) to evaluate image fog at the initial stage and at the finish of the durability test. As a filter, an amber light filter was used in the case of a cyan toner.

A: Less than 1.5%.

B: 1.5% or more and less than 2.5%.

C: 2.5% or more and less than 4.0%.

D: 4.0% or more.

(3) Ghosts:

A pattern was used in which, in images reproduced by the printer (an image chart in the case of a copying machine), solid-black hieroglyphic images (such as black squares and black circles) in white background are arranged at regular intervals in a region corresponding to one round of the sleeve at the top of the images, and a halftone image is positioned in other region. Reproduced images were ranked according to how ghosts of the hieroglyphic images appear on the halftone image. (Positive ghosts refer to ghosts having a higher image density than the halftone, and negative ghosts refer to ghosts having a lower image density than the halftone.)

A: No difference in tone is seen at all.

B: A slight difference in tone is ascertainable depending on view angles.

C: Ghosts are clearly visually ascertainable.

D: Ghosts appear clearly as a difference in tone. The difference in tone is measurable with a reflection densitometer.

(4) Spots around Line Images:

As to spots around line images, the 8-point A-letters of the images for the durability test were observed on a microscope to make an evaluation according to the following judgement criteria.

A: Almost no spots around line images appear. Very good images.

B: Spots around line images somewhat appear, but good images are formed.

C: Images on the level of no problem in practical use.

D: Spots around line images appear

TABLE 4

| | Developer carrying member | Toner | Environment | Image density Initial stage | Image density 12,000 sheets | Fog Initial stage | Fog 12,000 sheets | Ghosts Initial stage | Ghosts 12,000 sheets | Spots around line images Initial stage | Spots around line images 12,000 sheets | N/N Toner consumption |
|---|---|---|---|---|---|---|---|---|---|---|---|---|
| Example: | | | | | | | | | | | | |
| 1 | S-1 | T-1 | H/H | 1.51 | 1.5 | A | A | A | A | A | A | |
| | | | L/L | 1.48 | 1.45 | A | A | A | A | A | A | 33.2 |
| 2 | S-2 | T-1 | H/H | 1.5 | 1.48 | A | A | A | A | A | A | |
| | | | L/L | 1.48 | 1.45 | A | A | A | A | A | A | 33.6 |
| 3 | S-3 | T-1 | H/H | 1.52 | 1.49 | A | B | A | A | A | B | |
| | | | L/L | 1.49 | 1.47 | A | A | A | B | A | A | 34.8 |
| 4 | S-4 | T-1 | H/H | 1.52 | 1.49 | A | A | A | A | A | B | |
| | | | L/L | 1.48 | 1.46 | A | A | A | A | A | A | 35.3 |
| 5 | S-5 | T-1 | H/H | 1.47 | 1.44 | A | A | A | B | A | A | |
| | | | L/L | 1.46 | 1.42 | A | A | A | A | A | A | 33.6 |
| 6 | S-6 | T-1 | H/H | 1.51 | 1.49 | A | A | A | A | A | A | |
| | | | L/L | 1.47 | 1.46 | A | A | A | A | A | A | 34.6 |
| 7 | S-7 | T-1 | H/H | 1.46 | 1.43 | A | A | A | B | A | A | |
| | | | L/L | 1.45 | 1.41 | A | A | A | B | A | A | 33.0 |
| 8 | S-8 | T-1 | H/H | 1.54 | 1.5 | A | A | A | A | A | B | |
| | | | L/L | 1.49 | 1.45 | A | A | A | A | A | A | 36.1 |
| 9 | S-9 | T-1 | H/H | 1.5 | 1.46 | A | A | A | A | A | A | |
| | | | L/L | 1.45 | 1.42 | A | A | B | B | A | A | 34.1 |
| 10 | S-10 | T-1 | H/H | 1.5 | 1.43 | A | B | A | B | A | C | |
| | | | L/L | 1.45 | 1.42 | A | B | B | C | A | B | 35.8 |
| 11 | S-14 | T-1 | H/H | 1.47 | 1.42 | A | B | A | C | B | C | |
| | | | L/L | 1.46 | 1.42 | A | C | B | C | A | C | 35.9 |
| 12 | S-1 | T-2 | H/H | 1.5 | 1.43 | A | B | A | B | A | B | |
| | | | L/L | 1.46 | 1.45 | A | B | A | B | A | A | 37.7 |
| 13 | S-1 | T-3 | H/H | 1.51 | 1.48 | A | A | A | A | A | A | |
| | | | L/L | 1.47 | 1.39 | B | C | A | B | B | B | 33.7 |
| 14 | S-1 | T-4 | H/H | 1.4 | 1.35 | B | B | B | C | B | B | |
| | | | L/L | 1.42 | 1.37 | B | C | B | B | B | B | 35.5 |
| 15 | S-1 | T-5 | H/H | 1.44 | 1.38 | B | B | B | C | B | C | |
| | | | L/L | 1.41 | 1.34 | B | C | C | B | B | C | 43.2 |
| 16 | S-1 | T-8 | H/H | 1.51 | 1.39 | A | B | A | B | B | C | |
| | | | L/L | 1.47 | 1.42 | B | C | A | B | B | C | 35.2 |
| 17 | S-1 | T-9 | H/H | 1.5 | 1.47 | B | B | A | B | A | B | |
| | | | L/L | 1.47 | 1.35 | B | C | B | B | B | C | 36.7 |
| 18 | S-1 | T-10 | H/H | 1.46 | 1.38 | B | C | B | C | B | C | |
| | | | L/L | 1.43 | 1.36 | B | B | C | B | B | C | 40.9 |
| Comparative Example: | | | | | | | | | | | | |
| 1 | S-1 | T-6 | H/H | 1.44 | 1.36 | A | B | A | C | B | C | |
| | | | L/L | 1.41 | 1.34 | C | D | B | B | B | C | 34.6 |
| 2 | S-1 | T-7 | H/H | 1.52 | 1.19 | A | B | A | C | A | D | |
| | | | L/L | 1.49 | 1.34 | A | C | B | B | A | C | 48.6 |
| 3 | S-11 | T-6 | H/H | 1.45 | 1.35 | B | C | B | D | B | D | |
| | | | L/L | 1.43 | 1.33 | C | D | B | C | C | C | 36.1 |
| 4 | S-13 | T-6 | H/H | 1.48 | 1.42 | A | C | A | C | B | D | |
| | | | L/L | 1.47 | 1.41 | C | D | C | D | A | C | 36.4 |
| 5 | S-15 | T-6 | H/H | 1.39 | 0.75 | B | D | C | D | A | D | |
| | | | L/L | 1.37 | 0.71 | C | D | C | D | B | C | 33.2 |

TABLE 4-continued

| | Developer | | | Image density | | Fog | | Ghosts | | Spots around line images | | N/N |
|---|---|---|---|---|---|---|---|---|---|---|---|---|
| | carrying member | Toner | Environment | Initial stage | 12,000 sheets | Initial stage | 12,000 sheets | Initial stage | 12,000 sheets | Initial stage | 12,000 sheets | Toner consumption |
| 6 | S-12 | T-7 | H/H | 1.51 | 1.05 | A | B | A | C | B | D | |
| | | | L/L | 1.48 | 1.3 | B | D | C | C | A | C | 50.9 |
| 7 | S-16 | T-7 | H/H | 1.45 | 0.92 | B | D | C | D | A | D | |
| | | | L/L | 1.4 | 0.77 | C | D | C | D | B | D | 32.6 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-108856, filed Apr. 11, 2006, which is hereby incorporated by reference herein in its entirety.

What is claimed is:

1. A developing method in which a developer held in a developer container is carried on a developer carrying member, and, while a thin layer of the developer is formed on the developer carrying member by the aid of a developer layer thickness control member, the developer is transported to a developing zone facing a latent image bearing member, where a latent image on the latent image bearing member is developed with the developer to render the latent image visible;

said developer comprising magnetic toner particles containing at least a binder resin and a magnetic powder;

said magnetic powder having a saturation magnetization of 67.0 $Am^2/kg$ or more and 75.0 $Am^2/kg$ or less in a magnetic field of 79.6 kA/m (1,000 oersteds) and having a residual magnetization of 4.5 $Am^2/kg$ or less; and said developer carrying member having at least a substrate and a conductive resin coat layer on the surface of the substrate;

said conductive resin coat layer satisfying, in its surface profile measured using a focus optics laser, $1.00 \leqq S/A \leqq 1.65$ where an area of microscopic unevenness regions from which parts exceeding a reference plane by 0.5×r (r: weight average particle diameter (μm) of a toner used) or more have been excluded is represented by A ($m^2$)and a surface area of microscopic unevenness regions is represented by S ($m^2$).

2. The developing method according to claim 1, wherein said conductive resin coat layer of said developer carrying member contains at least a binder resin and particles dispersed in the binder resin, and the particles has a volume average particle diameter of 3.0 μm or less.

3. The developing method according to claim 1, wherein, in said magnetic toner, toner particles in which at least 70% by number of iron oxide contained in the toner particles is present in a depth 0.2 times as deep as a projected-area-equivalent diameter C from the surface of each of toner particles being observed are contained in a proportion of 40% by number or more and 95% by number or less when the toner particles are observed using a transmission electron microscope.

4. The developing method according to claim 1, wherein said magnetic powder has a volume average particle diameter Dv of 0.15 μm or more and 0.35 μm or less.

5. The developing method according to claim 1, wherein said magnetic toner has an average circularity of 0.960 or more and 1.000 or less.

6. A developing assembly having a developer container which holds a developer therein, a means which carries the developer onto a developer carrying member and forms thereon a thin layer of the developer by the aid of a developer layer thickness control member, a means which transports the thin layer of the developer to a developing zone facing a latent image bearing member, and a means which develops with the developer a latent image formed on the latent image bearing member, to render the latent image visible;

said developer comprising magnetic toner particles containing at least a binder resin and a magnetic powder;

said magnetic powder having a saturation magnetization of 67.0 $Am^2/kg$ or more and 75.0 $Am^2/kg$ or less in a magnetic field of 79.6 kA/m (1,000 oersteds) and having a residual magnetization of 4.5 $Am^2/kg$ or less; and said developer carrying member having at least a substrate and a conductive resin coat layer on the surface of the substrate;

said conductive resin coat layer satisfying, in its surface profile measured using a focus optics laser, $1.00 \leqq S/A \leqq 1.65$ where an area of microscopic unevenness regions from which parts exceeding a reference plane by 0.5×r (r: weight average particle diameter (μm) of a toner used) or more have been excluded is represented by A ($m^2$)and a surface area of microscopic unevenness regions is represented by S ($m^2$).

7. The developing assembly according to claim 6, wherein said conductive resin coat layer of said developer carrying member contains at least a binder resin and particles dispersed in the binder resin, and the particles has a volume average particle diameter of 3.0 μm or less.

8. The developing assembly according to claim 6, wherein, in said magnetic toner particles, toner particles in which at least 70% by number of iron oxide contained in the toner particles is present in a depth 0.2 times as deep as a projected-area-equivalent diameter C from the surfaces of toner particles being observed are contained in a proportion of 40% by number and more to 95% by number or less when the toner particles are observed using a transmission electron microscope.

9. The developing assembly according to claim 6, wherein said magnetic powder has a volume average particle diameter Dv of 0.15 μm or more and 0.35 μm or less.

10. The developing assembly according to claim 6, wherein said magnetic toner has an average circularity of 0.96 or more and 1.000 or less.

* * * * *